US007285035B1

(12) United States Patent
Tullis

(10) Patent No.: US 7,285,035 B1
(45) Date of Patent: Oct. 23, 2007

(54) COLLISION OBSTACLES AND SENSORS FOR DETERMINING THE OUTCOME OF A RACE

(76) Inventor: Barclay J. Tullis, 1795 Guinda St., Palo Alto, CA (US) 94303

( * ) Notice: Subject to any disclaimer, the term of this patent is extended or adjusted under 35 U.S.C. 154(b) by 854 days.

(21) Appl. No.: 10/355,614

(22) Filed: Jan. 31, 2003

(51) Int. Cl.
*A63H 18/00* (2006.01)

(52) U.S. Cl. ..... 446/444

(58) Field of Classification Search ..... 446/444, 446/445; 463/59, 60, 58; 273/333, 382, 273/387, 393
See application file for complete search history.

(56) References Cited

U.S. PATENT DOCUMENTS

| | | | | |
|---|---|---|---|---|
| 4,198,758 | A | 4/1980 | Eineichner et al. | |
| 4,472,905 | A * | 9/1984 | Silverman et al. | 446/444 |
| 4,872,680 | A * | 10/1989 | Dennis | 463/59 |
| 5,255,185 | A * | 10/1993 | Mowers et al. | 340/323 R |
| 5,637,996 | A * | 6/1997 | McDarren et al. | 324/178 |
| 5,709,607 | A * | 1/1998 | Mowers et al. | 473/58 |
| 6,283,872 | B1 * | 9/2001 | Lichodziejewski et al. | 473/54 |
| 6,472,887 | B1 | 10/2002 | Tullis et al. | |

OTHER PUBLICATIONS

SuperTimer II. Feb. 23, 2001. http://web.archive.org/web/20010605194050/www.supertimer.com/pinewoodII/st2intro.html.*
SuperTimer II User's Manual. Feb. 23, 2001. http://web.arhive.org/web/20010619203728/www.supertimer.com/pinewoodII/usersmanual.html.*
SuperTimer II Example Pictures using S&W demo track. Feb. 23, 2001. http://web.archive.org/web/20010619203221/www.supertimer.com/pinewoodII/st2pix.html.*

* cited by examiner

*Primary Examiner*—Robert E Pezzuto
(74) *Attorney, Agent, or Firm*—Novelthink; Barclay J. Tullis

(57) ABSTRACT

A freestanding collision obstacle is disclosed which is propelled away from a collision obstacle sensing apparatus by the force of a collision event that occurs when a moving object, for example a toy vehicle such as a racecar, collides with the collision obstacle. A collision obstacle sensing apparatus is disclosed which incorporates a collision obstacle and a collision obstacle sensor, the latter of which senses the presence or absence of the collision obstacle. The collision obstacle sensing apparatus is thus used to detect an event time as the time of a collision event. Use of a collision obstacle and a collision obstacle sensing apparatus in each lane at the finish line of a multilane raceway, with the moving objects individually confined to respective lanes of the raceway, enables electronic determination of the outcome of a race. Preferred embodiments are disclosed using optical and/or capacitance sensors.

12 Claims, 22 Drawing Sheets

FIG. 20A
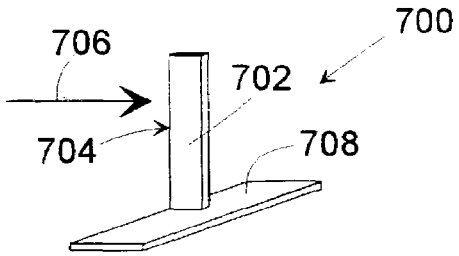
FIG. 20B
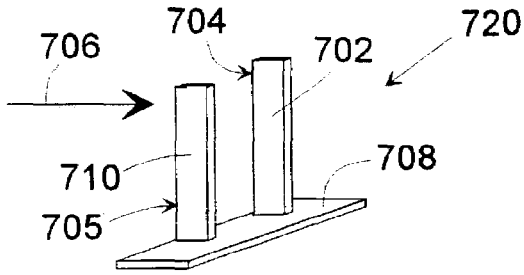
FIG. 20C
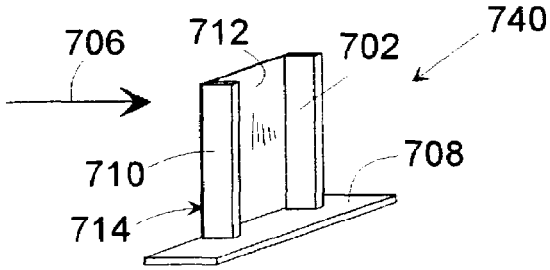
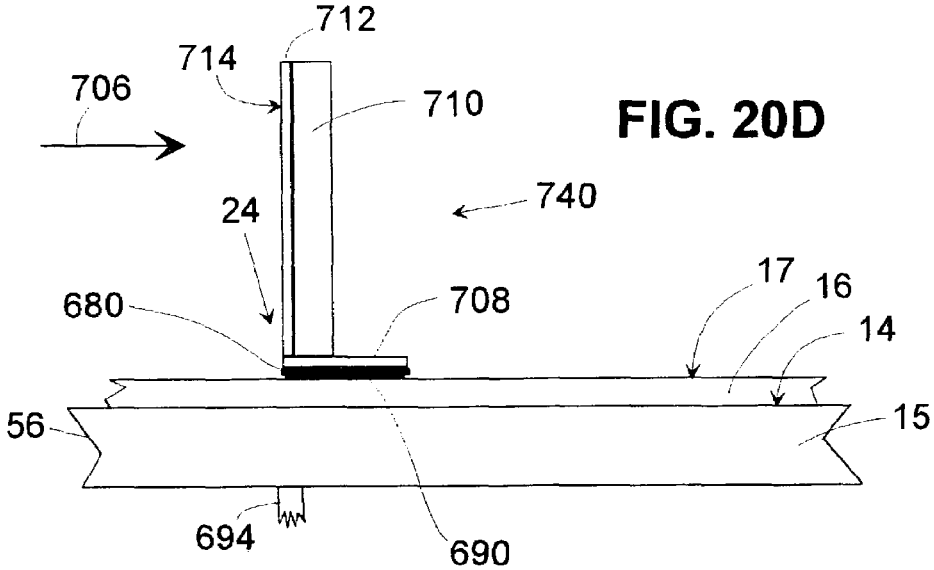
FIG. 20D

COLLISION OBSTACLES AND SENSORS FOR DETERMINING THE OUTCOME OF A RACE

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND OF THE INVENTION

1. Field of the Invention

This invention generally pertains to a sensing means by which to determine the moment in time that a moving object collides with a collision obstacle that is in cooperative association with a stationary sensor. It particularly pertains to a low-cost sensing apparatus for sensing the arrival of one or more toy vehicles (e.g. racecars) across the finish line on a raceway (e.g. a racetrack).

2. Description of Related Art

There are no prior art methods, structures, apparatuses, or devices published or on the market for utilizing a free collision obstacle in the path of a moving vehicle to electronically sense the arrival of the vehicle at a finish line. Within this disclosure, the meaning of "free" in "free collision obstacle" is that a collision obstacle is not rigidly or pivotally fastened to the raceway, but that the collision obstacle is free to be propelled away from the finish line by the force of a collision with a moving vehicle. What the prior art does use for sensing the arrival of a vehicle at a finish line is a variety of sensing techniques involving sensing apparatus that are fixed to the raceway.

The simplest prior art sensing apparatus comprises a phototransistor embedded in the raceway below the finish line, one phototransistor per lane of a multilane raceway. Overhead illumination is used, wherein race vehicles crossing the finish line interrupt light from the overhead illumination from reaching the respective phototransistor, thus accomplishing an event in the phototransistor that can be sensed directly by electronic means. Undesirable aspects of this approach include the inconvenience of having to supply overhead illumination, the effects that unequal shapes of vehicles have on the interruption of light to the phototransistors, and that background illumination such as camera flashes can affect the timing of the phototransistor's detection event.

More sophisticated prior art utilizes slotted photosensors in conjunction with a trip-lever located in each lane of a racetrack for toy racecars. A racecar reaching the finish line knocks a pivoted lever over. On the pivoted lever is a small optically opaque flag that interrupts the beam in the slotted photosensor, and when the pivoted lever rotates, this flag is thus carried out of the slot in the photosensor. This approach leads to a more expensive structure, as the slotted photosensor has to be prearranged structurally with the flag and to the swing-path of the lever for proper operation. The resulting assembly of a lever arm, a flag, a pivot axle, a slotted photosensor, along with the structure to support these in an operating unit, is large enough to require a large mounting hole be cut through the bed of the racetrack. The advantage of this approach, however, using a slotted photosensor and an optically opaque flag on a pivoting trip-lever, is that it provides for greater precision and accuracy than the phototransistor approach that uses overhead illumination. The slotted phototransistor affords a greater protection from false operation caused by background illumination, and the sensor in each lane of the raceway can be made to operate more consistently, one compared to another. Precision and accuracy of better than 0.001 sec can easily be achieved with this approach.

Mechanical micro-switches have been tried in the prior art but have not been favored due to their lack of timing repeatability. The timing response of micro-switches to actuation events can vary one event to another by over ten milliseconds, even when de-bounced electronically. For vehicles traveling approximately 16 km/hr (approximately ten miles per hour), this can cause errors in finish line event timing equivalent to the time it takes a racecar to travel a few centimeters (just over an inch). For races where the racecars are separated by less than 2 to 3 cm (approximately an inch) approaching the finish line, this error magnitude is unacceptable.

What is needed that is not provided by the prior art are sensing apparatuses and methods that are at the same time: low cost, easy to install, precise and accurate in detection of finish line events, insensitive to ambient lighting conditions, convenient and easy to use, cause little damage to toy racecars, don't cause toy racecars to jump out of their lanes, and actually add excitement to a race.

OBJECTS AND ADVANTAGES

A freestanding collision obstacle is disclosed which is propelled away from a collision obstacle sensing apparatus by the force of a collision event that occurs when a moving object, for example a toy vehicle such as a racecar, collides with the collision obstacle. A collision obstacle sensing apparatus is disclosed which incorporates a collision obstacle and a collision obstacle sensor, the latter of which senses the presence or absence of the collision obstacle. The collision obstacle sensing apparatus can be used to detect an event time as the time of a collision event. Use of a collision obstacle and a collision obstacle sensing apparatus in each lane at the finish line of a multilane raceway, with the moving objects individually confined to respective lanes of the raceway, enables electronic determination of the outcome of a race. Preferred embodiments are disclosed using optical and/or capacitance sensors.

A first objective of this invention is to reduce the cost of sensor apparatuses used to sense the crossing of toy vehicles (e.g. racecars) across a finish line wherein each vehicle is confined to travel in a respective lane of a raceway (e.g. a racetrack). A second objective is to simplify sensor installation requirements on a raceway by reducing the labor required of the raceway owner or operator and by minimizing drilling and/or cutting required installing such sensor apparatuses on the raceway. A third objective is to simultaneously add a new component of action and excitement to vehicle races with the addition of collision interaction between racing vehicles and collision objects placed in the paths of these vehicles at the finish line.

BRIEF SUMMARY OF THE INVENTION

Certain objects, advantages and novel features of the invention will be set forth in part in the description that follows and in part will become apparent to those skilled in the art upon examination of the following or may be learned with the practice of the invention. The objects and advantages of the invention may be realized and obtained by means of the methods and apparatuses and combinations particularly pointed out in the appended claims.

The objects of the invention are principally to provide apparatuses, for sensing finish line events, that a) are low in cost, b) can be installed on a racetrack or other raceway without cutting large or complicated holes, c) permit precise and accurate sensing of finish line events (to at least +–0.001 sec), d) are convenient to use, e) remain protected from effects of ambient lighting conditions on the photosensor, and f) actually add excitement to the race experience. The object of the invention is also to provide methods for sensing finish line events in manners that are simple to learn and carry out and that prevent set-up and operation from having variable influence on race results.

These and other objects of the invention are provided by a novel use of a freestanding collision obstacle comprising: a) a collision surface that can be positioned and oriented to make first contact with a moving object; b) a sensor-interaction feature capable of interaction with a stationary sensor; c) a base supporting both said collision surface and said sensor-interaction feature; wherein said freestanding collision obstacle is a free collision obstacle; and wherein said stationary sensor is located beneath said collision obstacle prior to a collision.

For each lane in a racetrack (or other raceway) along which a racecar travels (or along which some other moving object travels), a freestanding collision obstacle is placed to rest over a sensor that is anchored to the racetrack (e.g. to the structure of the racetrack, such as on, in, and/or below a race surface of a racetrack). The collision obstacle includes a sensor interacting feature. Before a race, the collision obstacle is positioned such that this sensor interacting feature interacts with the sensor. If the sensor used is a slotted photosensor, and if the sensor interacting feature is an optically opaque flag, then the optically opaque flag is positioned in the slot of the slotted photosensor before a race. As moving objects (such as racecars) cross the finish line, they each collide with a respective collision obstacle and knock it free of the sensor it is positioned over (i.e. that with which it is associated), thus causing the sensor-interaction feature to leave the sensor. As a collision obstacle leaves its associated sensor, the sensor experiences a change in its sensing condition, thus determining an electronic event in the sensor. If the sensor used is a slotted photosensor, and if the sensor interacting feature is an optically opaque flag, then a collision with the collision obstacle knocks the optically opaque flag out of the slot in the slotted photosensor. Note that if a slotted photosensor is used, then until a collision occurs to knock the associated collision obstacle away, the collision obstacle can effectively block ambient light from entering the slotted photosensor, a definite advantage over prior art arrangements using photosensors exposed to ambient light.

The primary novelty of this invention is that it is together simple in structure (and therefore low cost), easy to install, accurate and precise, easy to align, easy to use, insensitive to background illumination conditions, and adds excitement to the race experience (by having finish line events be accompanied by collision obstacles being knocked free of the finish line).

The preferred implementation of this invention utilizes a cubical or rectangular shaped foam block with an attached optically opaque flag set up before a race to interrupt the light beam of a slotted photosensor attached at the finish line in the lane of a racetrack and beneath the path of a racecar. When a racecar arrives at the finish line, it collides with this block and knocks it (and its attached flag) off of the photosensor and finish line. Other embodiments can utilize photoreflective type photosensors (rather than slotted photosensors) and a reflective surface on the block (obstacle) instead of a flag. Still other embodiments utilize capacitance sensors beneath the block (obstacle) wherein the block (obstacle) can have a metal strip attached or can otherwise be purely of dielectric material(s). Other embodiments can utilize collision obstacles with shapes other than cubical, such as animal shapes, spherical shapes that sit in a shallow recess on the track, and/or shapes that will affect the direction they fly when collided into by a racecar. Collision obstacles should generally be made lighter in weight than the moving objects that collide into them.

The reader will readily appreciate the novelty and added value of using a collision obstacle in the sensing of the moment in time when a moving object reaches a finish line.

BRIEF DESCRIPTION OF THE DRAWINGS

The accompanying drawings incorporated in and forming a part of the specification illustrate several aspects of the present invention, and together with the description serve to explain the principles of the invention. In the drawings:

In FIG. 4A, the flag is not in a position to block the beam of light that traverses the slot of the photosensor. In FIG. 4B, the flag is located within the slot and blocks the beam of light.

FIGS. 5A and 5C show both a slotted photosensor, mounted to the bottom of the track, and a flag, mounted to a structural member of the start gate.

FIG. 13 B shows the slot of the slotted finish sensor supported to stick up just above the top surface of the guide rail of the track. FIG. 13C shows the slot at a lower position at or below the top surface of a guide rail.

FIG. 17B shows a bottom contour of a tapered groove 564 configured within the guide rail to clear the flag as it is propelled down the track by a colliding racecar.

FIG. 18A is an exploded view, and FIG. 18B shows the finished assembly. Both views show a tapered-depth groove 564 as also depicted in FIG. 17B.

FIGS. 20A, 20B, and 20C show further alternative implementations of collision obstacles, wherein structures other than cubical blocks are used in the current invention, and wherein these structures have bottom surfaces as well as collision surfaces and can be implemented with either an optically opaque flag or a region that is conductive. FIG. 20A shows a collision surface on a vertical member. FIG. 20B shows collision surfaces formed by a pair of vertical members. FIG. 20C shows a relatively wide collision surface. FIG. 20D shows the collision obstacle of FIG. 20C positioned over a capacitance sensor installed in the lane of a track.

LIST OF REFERENCE NUMERALS USED IN THE DRAWINGS

Figure 1:
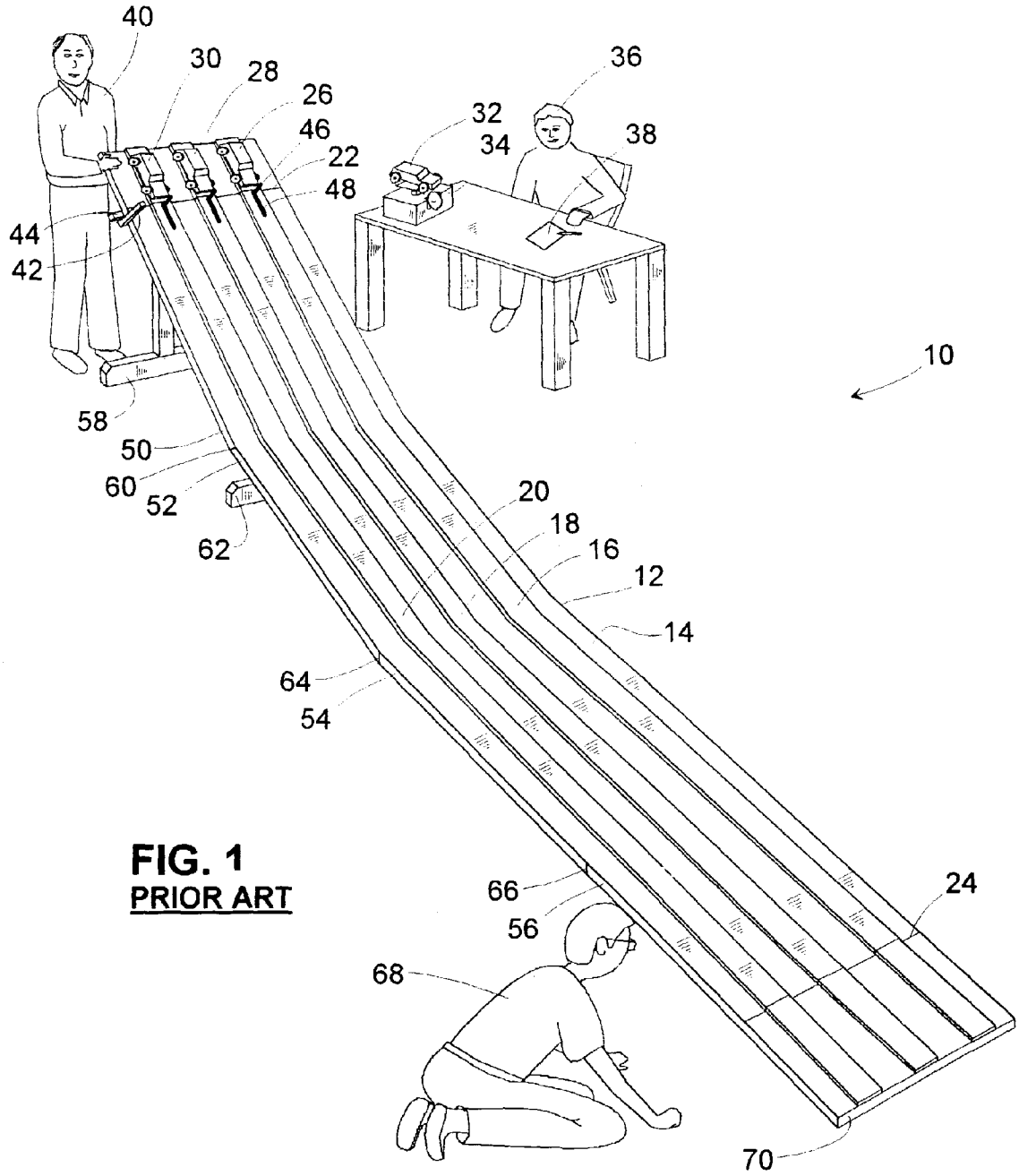
FIG. 1 PRIOR ART
FIG. 1 is an elevated perspective view showing toy racecars on a track with a start gate used in a toy car race, and showing certain aspects important to the race using prior art.

| | |
|---|---|
| 10 | Race Set-Up |
| 12 | Track |
| 14 | Race Surface |
| 15 | Track Base |
| 16, 18, 20 | Guide Rail |
| 17 | Guide Rail Top Surface |
| 22 | Start Line |
| 24 | Finish Line |
| 26, 28, 30 | Racecar |
| 32 | Car Being Weighed |
| 34 | Scale |
| 36 | Referee (or Recorder Person) |
| 38 | Logbook |
| 40 | Starter Person |
| 42 | Start Handle |
| 44 | Start Bar |
| 46 | Start Gate Dowel (or Barrier) |
| 48 | Dowel Slot |
| 50 | First Section (or Head End Section) |
| 52 | Second Section |
| 54 | Third Section |

-continued

| | |
|---|---|
| 56 | Fourth Section (or Finish Line Section) |
| 58 | First Support |
| 60 | First Joint |
| 62 | Second Support |
| 64 | Second Joint |
| 66 | Third Joint |
| 68 | Judging Person |
| 70 | Track End |
| 72 | Bottom of Track |
| 82 | First Eyelet Anchor |
| 84 | Second Eyelet Anchor |
| 86 | Rubber Band or Spring |
| 90 | Latching Surface |
| 92, 94 | Start Bar Hinges |
| 96 | Optically Opaque Flag |
| 97 | Flag Mounting Member |
| 98 | Flag Mounting Hole |
| 100 | Start Sensor |
| 102 | First Finish Sensor |
| 104 | Second Finish Sensor |
| 106 | Third Finish Sensor |
| 108 | Processor |
| 110 | Start Sensor Interface |
| 112 | First Finish Sensor Interface |
| 114 | Second Finish Sensor Interface |
| 116 | Third Finish Sensor Interface |
| 118 | Display |
| 120 | Display Interface |
| 122 | Reset Button |
| 124 | Reset Button Interface |
| 126 | Power Supply |
| 128 | Power Supply Interface |
| 130 | On/Off Switch |
| 132 | On/Off Switch Interface |
| 150 | Slotted Photosensor |
| 152 | Slot |
| 154 | Light Beam |
| 156 | Detector Leads |
| 158 | Source Leads |
| 160 | Bracket |
| 162 | Cable |
| 164 | Path |
| 200 | Upswinging Start Gate in Closed Position |
| 200' | Upswinging Start Gate in Open Position |
| 210 | Start Gate Barrier Member |
| 212 | Start Gate Axle |
| 214 | First Side of Start Gate Support |
| 216 | Second Side of Start Gate Support |
| 218 | Start Gate Handle |
| 220 | Direction |
| 222 | First Stop |
| 224 | Second Stop |
| 226 | First Anchor Point |
| 228 | Second Anchor Point |
| 230 | Tensioned Elastic Member |
| 232 | Start Gate Release Mechanism |
| 234 | Start Gate Photosensor |
| 236 | Start Gate Flag |
| 238 | Cable |
| 240 | Direction |
| 300 | Finish Sensor Installation |
| 310 | Photosensor |
| 312 | Photosensor Mounting Hole |
| 318 | Overhead Illumination |
| 320 | Useful Beam |
| 322 | Overhead Lamp |
| 324 | Cable |
| 326 | Direction |
| 328 | Cable Clamp |
| 330 | First Support Member |
| 332 | Second Support Member |
| 334 | Racecar |
| 350 | Flag and Arm Subassembly |
| 352 | Flag |
| 353 | Pivot Hole |
| 354 | Arm |
| 360 | Pivoting Flag and Arm Subassembly |
| 362 | Pivot Axle |
| 364 | Mounting Bracket |

-continued

| | |
|---|---|
| 365 | Axle-Mounting Hole |
| 370 | Uncovered, Closed Finish Sensor Subassembly |
| 370' | Uncovered, Open Finish Sensor Subassembly |
| 372 | Cabled Photosensor Subassembly |
| 374 | Slotted Photosensor |
| 376 | Cable |
| 380 | Closed Finish Sensor Top Assembly |
| 380' | Open Finish Sensor Top Assembly |
| 382 | Cover |
| 390 | Top Assembly |
| 392 | Rectangular Hole |
| 394 | Bracket Screw Hole |
| 396 | Bracket-Mounting Screw Hole |
| 398 | Head of a Bracket Mounting Screw |
| 410 | First Racecar |
| 412 | Second Racecar |
| 414 | Third Racecar |
| 416 | First Leading Edge |
| 418 | Second Leading Edge |
| 420 | Third Leading Edge |
| 422 | First Interfering Object |
| 424 | First Width |
| 430 | Second Interfering Object |
| 432 | Second Width |
| 440 | Fourth Racecar |
| 442 | Fifth Racecar |
| 444 | Sixth Racecar |
| 446 | Travel Direction |
| 448 | Fourth Leading Edge |
| 450 | Fifth Leading Edge |
| 452 | Sixth Leading Edge |
| 454 | First Collision Obstacle |
| 456 | Second Collision Obstacle |
| 458 | Third Collision Obstacle |
| 460 | Length Dimension |
| 462 | Height Dimension |
| 464 | First Collision Surface |
| 466 | Second Collision Surface |
| 468 | Third Collision Surface |
| 470 | First Propulsion Direction Vector |
| 472 | Second Propulsion Direction Vector |
| 474 | Third Propulsion Direction Vector |
| 500 | Race in Progress |
| 502 | First Collision Obstacle |
| 504 | Second Collision Obstacle |
| 506 | Third Collision Obstacle |
| 508 | Sensor Cables |
| 510 | Direction of Cables to Processor |
| 512 | Finish Sensor PCB |
| 514 | Slotted Finish Sensor |
| 515 | Photosensor Slot Bottom |
| 516 | Gap |
| 520 | Cable |
| 522 | Passthrough Hole |
| 524 | PCB Mounting Hole |
| 526 | Mounting Screw |
| 528 | Spacer Washer |
| 550 | Collision Obstacle Assembly |
| 552 | Collision Block |
| 554 | Bottom |
| 556 | Collision Surface |
| 558 | Slit |
| 560 | Opaque Optical Flag |
| 562 | Flag Base Member |
| 564 | Tapered-Depth Groove |
| 570 | Collision Obstacle Assembly |
| 572 | Collision Block |
| 574 | Bottom Surface |
| 576 | Collision Surface |
| 578 | Cavity |
| 580 | Optically Opaque Flag |
| 590 | Collision Obstacle Assembly |
| 592 | Collision Block |
| 594 | Semi-Rigid Bottom Sheet |
| 596 | Collision Surface |
| 598 | Optically Opaque Flag |
| 610 | Collision Obstacle Assembly |
| 612 | Collision Block |
| 614 | Semi-Rigid Bottom Sheet |

-continued

| | |
|---|---|
| 616 | Collision Surface |
| 618 | Optically Opaque Flag |
| 620 | Leveling Bar |
| 652 | Direction of Racecar Travel |
| 654 | Slotted Photosensor |
| 656 | Printed Circuit Board (PCB) |
| 658 | Mounting Screw |
| 660 | Washer |
| 670 | Collision Obstacle Assembly |
| 672 | Collision Block |
| 674 | Bottom |
| 676 | Collision Surface |
| 680 | Cooperative Element |
| 690 | Electrode Pair |
| 692 | Cable Hole |
| 694 | Cable |
| 696 | Direction |
| 700 | Single-Bar Collision Obstacle Assembly |
| 702 | First Vertical Member |
| 704 | First Collision Surface |
| 705 | Second Collision Surface |
| 706 | Direction of Travel |
| 708 | Base Member |
| 710 | Second Vertical Member |
| 712 | Vertical Plate |
| 714 | Third Collision Surface |
| 720 | Double-Bar Collision Obstacle Assembly |
| 740 | Vertical Plate Collision Obstacle Assembly |
| 800 | Collision Obstacle Assembly |
| 802 | Collision Cylinder |
| 804 | Cylinder Bottom |
| 806 | Collision Surface |
| 808 | Optically Opaque Conical Flag |
| 812 | Mounting Hole |
| 814 | Conically Slotted Photosensor |
| 816 | Cable |
| 818 | Direction |
| 901 | Step 1 |
| 902 | Step 2 |
| 903 | Step 3 |
| 904 | Step 4 |
| 905 | Step 5 |
| 906 | Step 6 |
| 907 | Step 7 |

DETAILED DESCRIPTION OF THE INVENTION

Having summarized various aspects of the present invention, reference will now be made in detail to the description of the invention and its relation to prior art, both as illustrated in the drawings. While the invention will be described in connection with these drawings, there is no intent to limit it to the embodiment or embodiments disclosed therein. On the contrary, the intent is to cover all alternatives, modifications and equivalents included within the spirit and scope of the invention as defined by the appended claims.

Reference will first be made to FIG. 1 and FIG. 2 that illustrate a racetrack along with elements important to the conduct of a race using the prior art in what is referred to as a completely manual mode of operation. Reference will then be made to FIG. 3 that shows a block diagram of an electronic system that uses sensors installed on a track to detect the moments racecars are released at a start line and later cross a finish line. Reference will then be made to FIG. 4 and FIG. 5 that show a slotted photosensor and how it is used to sense the start of a race. Next, reference will be made to FIG. 6 that shows an apparatus improved over the prior art for starting races. Reference will then be made to FIG. 7, FIG. 8, and FIG. 9 that show two different prior art apparatuses used for sensing when racecars cross a finish line. Reference will then be made to FIG. 10 that shows how racecar and sensor geometry can interact to affect race times, and how geometry may also affect the action achieved with using collision blocks (collision obstacles) to sense the finish of a race. Lastly, FIGS. 11 through 20 will be referenced in describing the rest of the current invention along with its implementations, features, and benefits.

FIG. 1 is an elevated perspective view showing toy racecars positioned at a start gate to race on a track, wherein gravity provides the acceleration force to motivate the racecars down the first section(s) of the track. Certain other aspects important to the race are also shown. The race set-up 10 is popular with children in organized groups and, in the original prior art, has been run in a manual-mode without electronic timers and without electronic judging at the finish line.

A race set-up 10 typically includes a track 12 having a race surface 14, wherein the wheels of the racecars are made to run upon the race surface 14. The number of racecars that can run on a track at any one time varies from track to track, but FIG. 1 illustrates a three-lane track for three racecars to race at any one time or in any one heat of a race. Guide rails define individual lanes of a track, and FIG. 1 shows three guide rails 16, 18, and 20. The track 12 has a start line 22, where racecars begin a race, and a finish line 24, where they finish a race. To set up for a race on track 12, racecars such as 26, 28, and 30 are placed at the start line 22. Tracks are traditionally made largely of wood materials, although some tracks are made primarily of plastic and/or aluminum.

To keep the race fair, regarding the weights of the racecars, each racecar, such as the racecar being weighed 32 on the scale 34, is weighed by a referee 36 to assure the racecar doesn't weigh more than a specified maximum, for example 5 ounces, as set by a set of rules for the race. Information about each racecar that participates is entered in a logbook 38 where a referee 36 (or recorder person) records the name of the owner of the racecar, the weight of the racecar, the heats in which the racecar was included, and the place-finishing results of each heat. The logbook may contain other race information such as a) the identity of the organization conducting the race, b) information about those participating in the race, c) information about those managing and judging the race, d) the sequence of heats comprising the race, e) the advancement of racecars to run-off heats, f) the results of run-off heats, and g) a record of participants or racecars receiving performance recognition and/or awards.

To begin a race (or a heat of a race), a starter person 40 controls a start handle 42 (or other starting mechanism) to release a start bar 44 that simultaneously lowers a barrier in each lane (such as the barrier 46 or start gate dowel 46 in the lane defined by the guide rail 16). Note that the start bar 44 lowers the start gate dowels (such as 46) out of the way of the racecars 26, 28, and 30 by lowering the start gate dowels (such as 46) into respective dowel slots in the guide rails 16, 18, and 20 (such as dowel slot 48 in guide rail 16).

Typically, a track 12 consists of four sections: a first section 50 (also called the head end section), a second section 52, a third section 54, and a fourth section 56 (also called the finish line section). These track sections 50, 52, 54, and 56 each typically measure about 2.44 meters (8 feet) in length and are attached together in end-to-end sequence. In FIG. 1, track section 50 is the head end section or the one with the start bar 44 and the start line 22. This head end section 50 is elevated the highest of the four sections. First support 58 is positioned near the end of the head end section 50 that contains the start line 22, and elevates the start gate 22 about 1.22 meters (4 feet). A second support 62 supports the track 12 at a lower elevation. Second support 62 provides support for the track 12 at a first joint 60 where the first section 50 is joined to the adjacent second section 52. The elevation of this first joint 60 is typically about 30 cm (1 foot). Typically, the other end of section 52 is supported at an elevation nearer to the floor. The second joint 64, where second section 52 is joined to the adjacent third section 54, is kept at the same elevation as both the third joint 66, where the third section 54 is joined to the adjacent fourth section 56, and as the track end 70 nearest the finish line 24.

Gravity accelerates the racecars down the track 12 along the first two sections 50 and 52 of the track 12, and the racecars typically coast along the second two sections 54 and 56.

At the finish line 24, a judging person 68 is required to observe the order in which the racecars cross the finish line. The results of the race, as observed and judged by the judging person 68, are typically recorded in the logbook 38.

Not shown in FIG. 1, but important to the environment of such a race, is the presence of other race organizers, race managers, race participants (the racecar owners), and observers emotionally involved in the race(s) and results. Often many of these people are crowded about the last section of the track, intent on the racecar action at the finish line.

Figure 2A:
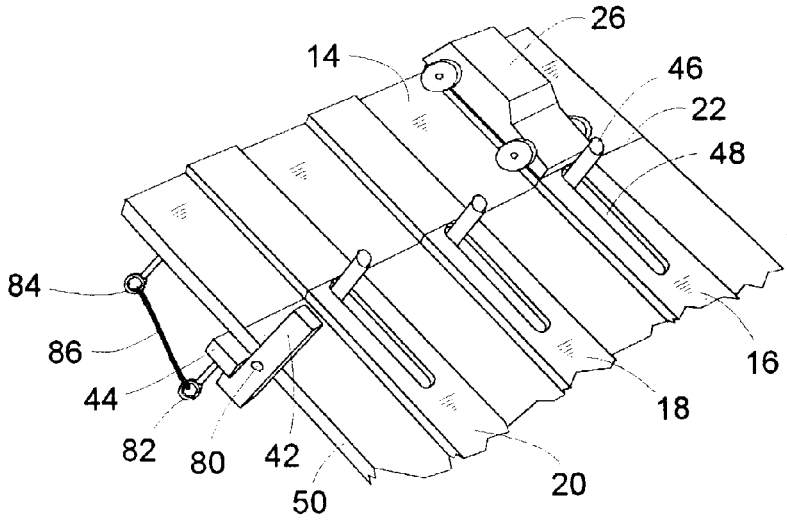
FIG. 2A PRIOR ART
FIGS. 2A and 2B are elevated perspective views of the head end of a track, according to prior art, showing the start gate in the closed and open positions respectively. In a similar manner.
Figure 2C:
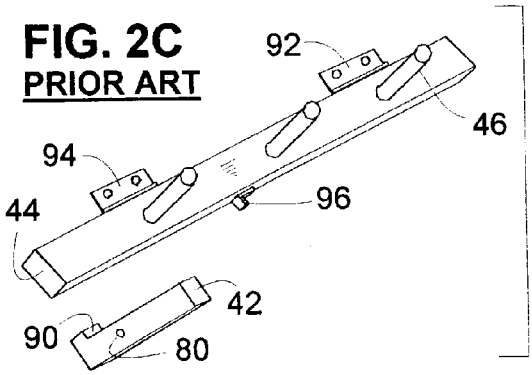
FIG. 2C PRIOR ART
FIGS. 2C and 2D are elevated perspective views of the start gate in the same respective positions as in FIGS. 2A and 2B, but without the track, to which the gate is otherwise supported, obscuring the view.
Figure 2D:
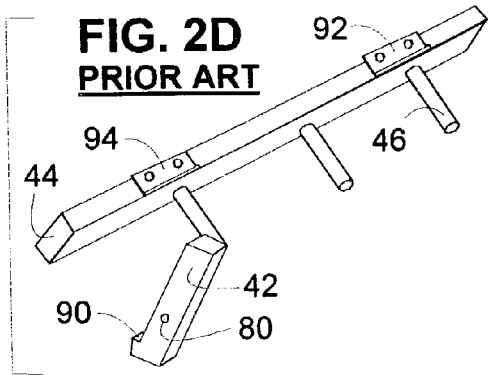
FIG. 2D PRIOR ART
Figure 2B:
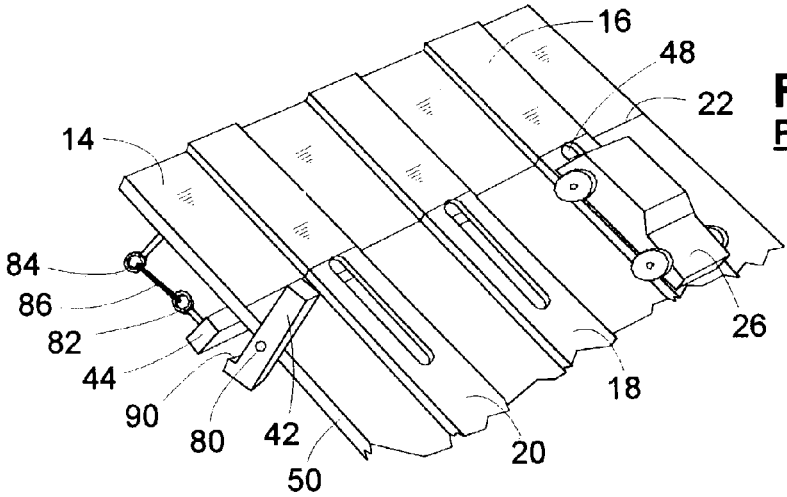
FIG. 2B PRIOR ART
Figure 3:
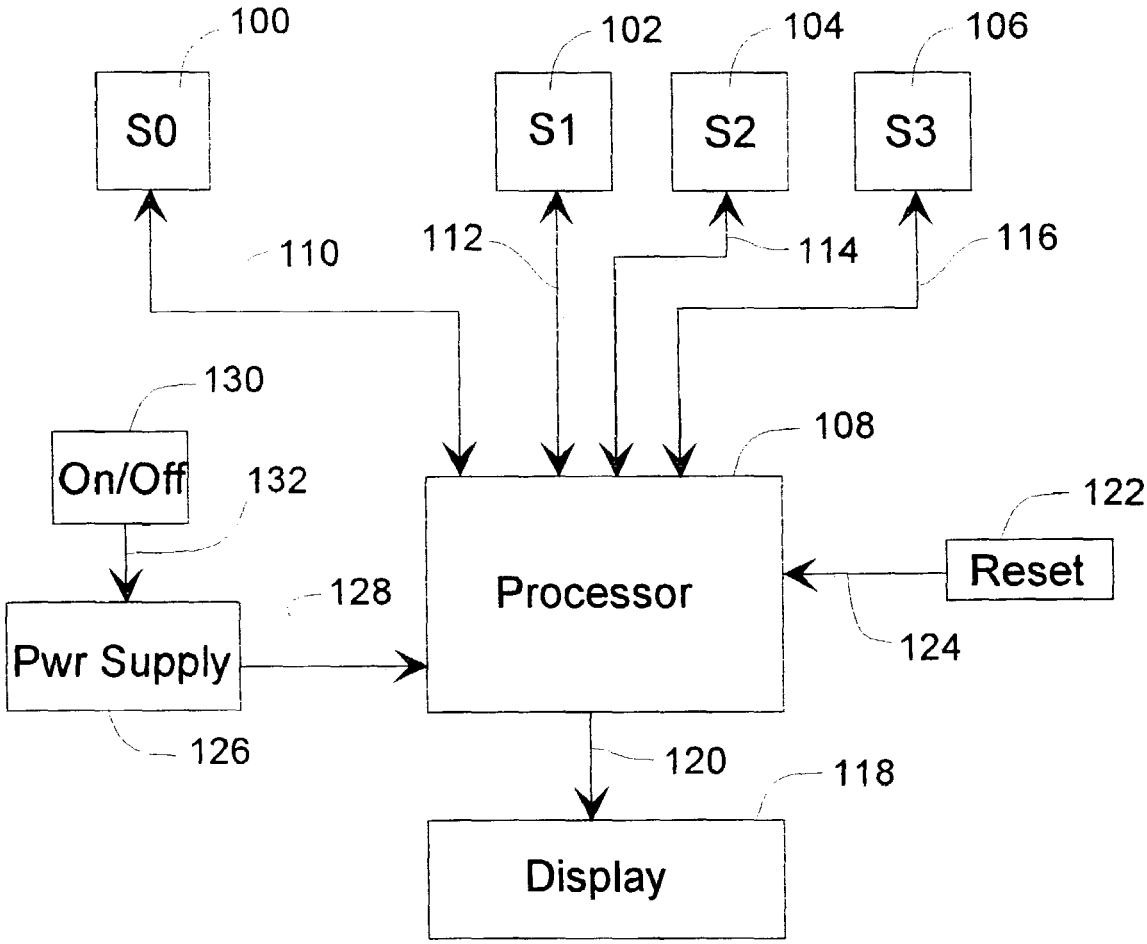
FIG. 3 PRIOR ART
FIG. 3 shows, according to prior art, a system block diagram of an electronic apparatus used to time and/or judge a toy car race, wherein sensors are provided for an exemplary three lanes of a generally multilane toy car race.

FIGS. 2A and 2B are elevated perspective views of the head end of the head end section 50 of the track 12 showing the start gate in the closed and open positions respectively, according to prior art. For simplicity of illustration, only one racecar 26 is shown rather than all three racecars 26, 28, and 30. In FIG. 2A, with the start bar 44 in the closed position, the gate barriers (such as the start gate dowel 46) are raised, and racecar 26 rests against its barrier 46 in a position ready for a race to start. FIG. 2B shows the start bar 44 in the open position, wherein the gate barriers (such as the start gate dowel 46) have been lowered beneath the track through dowel slots (such as the dowel slot 48) and are out of view. FIG. 2B shows a position of the racecar 26 moments after the start bar 44 has opened. Note in FIG. 2B that the racecar 26 is pulled down the track 12 under the influence of gravity and is guided by the guide rail 16. The wheels of the racecars (such as racecar 26) are supported and run along the race surface 14.

FIGS. 2A and 2B show how the start handle 42 pivots about a pivot axle 80. FIGS. 2A and 2B also show a first eyelet anchor 82 anchored to the start bar 44, a second eyelet anchor 84 anchored to the underside of the track section 50, and a rubber band or spring 86 stretched between the two eyelets 82 and 84. In FIG. 2A, the start handle 42 is shown holding the start bar 44 in the closed position by way of a latching surface 90 (the latching surface 90 is not visible in this condition). In FIG. 2B, the start handle 42 has been pivoted to release the start bar 44, exposing the latching surface 90 to view. The function of the rubber band or spring 86 is to open the start bar 44 quickly when the start handle 42 is pivoted from the closed position shown in FIG. 2A to the open position shown in FIG. 2B. The opening of the start gate 44 must be fast enough that the start gate dowels (such as start gate dowel 46 in guide rail 16) move ahead of the racecars (such as racecar 26) fast enough to prevent interference with the racecars once the start bar 42 is opened.

FIGS. 2C and 2D are elevated perspective views of the start gate in the same respective positions as in FIGS. 2A and 2B, but without the track, to which the gate is otherwise supported, obscuring the view. Without the track obscuring she view of the start gate 44, it can be seen that the start gate dowels (such as 46) are anchored in the start bar 44. It can also be seen that the start bar 44 has two hinges 92 and 94 attached to it for attachment as well to the underside of the head end section 50 of the track. These hinges 92 and 94 are what permit the start bar 44 to swing between the open and closed positions. Note that the latching surface 90 is made visible in both the open and closed positions (in FIGS. 2C and 2D respectively) by an artificial displacement of the start bar 44 away from the start handle 42.

FIG. 2C also shows an optically opaque flag 96 attached to the start bar 44. This optically opaque flag 96 will discussed below in the description of FIGS. 4 and 5.

FIG. 3 shows, according to prior art, a system block diagram of an electronic apparatus used for a toy car race to measure the elapsed time of racecars as they travel between a start line and a finish line, and/or to determine or otherwise judge the order or place position in which racecars cross the finish line. Electronic apparatuses, as shown in FIG. 3, were first invented and used by this inventor for toy car races and have been sold on the market under the product name "Timestopper" by Intelligent Automation Company of California for more than the past 20 years. Such a system is designed for tracks on which a guide rail is used in each lane to restrict the path of each racecar in such a manner that they won't collide or otherwise interfere with one another. Multiple finish sensors are provided, one for each lane of a track. First, second, and third finish sensors S1, S2, and S3 (102, 104, and 106 respectively) are provided in this example for a three-lane track. In such systems, as represented by FIG. 3, a processor 108 receives first, second, and third finish signals respectively over corresponding first, second, and third finish sensor interfaces 112, 114, and 116 from finish sensors 102, 104, and 106 located at a finish line.

If elapsed times are to be measured (for each racecar), a start sensor S0 or 100 is included. As shown in FIG. 3, the start sensor 100 sends a start signal over start interface 110 to the processor 108. One skilled in the art can appreciate that each of the interfaces above can be electrically conductive cable, or wireless links using radio or light wave technologies.

FIG. 3 shows a reset button 122 connected to the processor 108 by way of a reset button interface 124. FIG. 3 also shows an ON/OFF switch 130 controlling a power supply 126 through an on/off switch interface 132. The power supply 126 is in turn connected to the processor 108 by way of a power supply interface 128. The processor 108 can also use the appearance of power over the power supply interface 128 as a signal to reset itself on power-up of the processor 108. A display 118 is connected to the processor 108 by way of a display interface 120.

As known in the prior art, the place positions of racecars that finish a race, such as first place, second place, and third place (for the example of a three-lane track) can be displayed on the display 118. After the results of a race are displayed on the display 118, and possibly recorded into a logbook, the processor 108 can be reset using either a new power-up event or by pressing the reset button 122.

If the start sensor 100 is included, its signal at the start of a face begins a timing process by the processor 108 maintaining an internal clocking function. Subsequently, as racecars cross the finish line, the processor senses their crossings and not only captures and compares their finishing sequence positions but also displays their elapsed race times. The elapsed race time of a racecar is either a) calculated as the difference between the time of a start signal and the time of the finish signal for that racecar, or b) as the time clocked between the moment of the start signal and the moment of the finish signal for that racecar. The processor can be a single-purpose hand-held unit, a multipurpose portable unit such as a personal digital assistant (PDA), or a desktop or laptop personal computer. The display 118 can be built into a hand-held or portable unit, can be a general-purpose display monitor such as used with a personal computer, or can be a remote secondary display. Another example of prior art that discloses the use of time-event signals, such as signals from start and finish sensors, to determine elapsed times is U.S. Pat. No. 4,198,758 entitled "Chain Measuring and Conveyor Control System", issued Apr. 22, 1980 to Donald E. Eineichner and Barclay J. Tullis, the teachings of which are herein incorporated by reference. One skilled in the art can appreciate that the electronic system, as depicted by example in FIG. 3, can be structured according to any of a large variety of system architectures and physical forms.

Figure 4A:
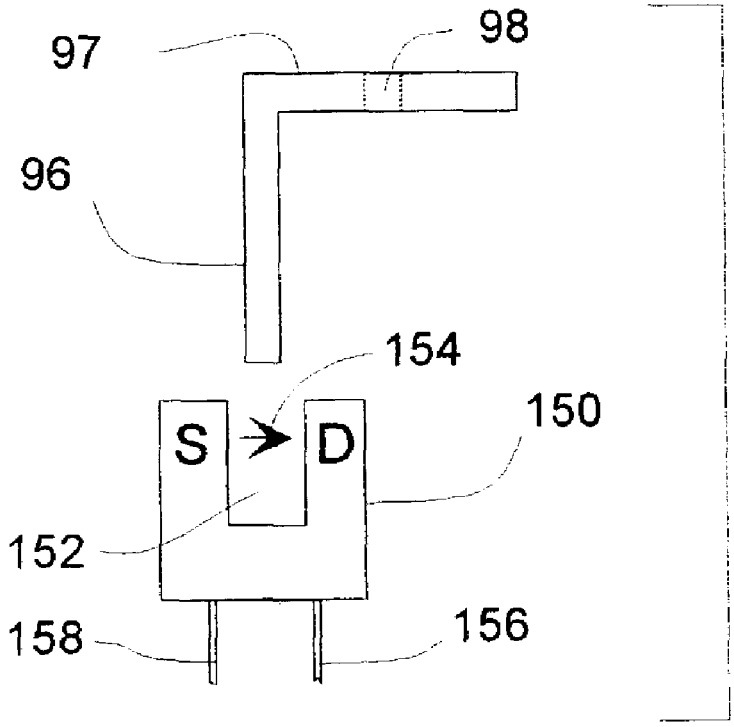
FIG. 4A PRIOR ART
FIGS. 4A and 4B show a prior art slotted photosensor along with an optically opaque flag.
Figure 4B:
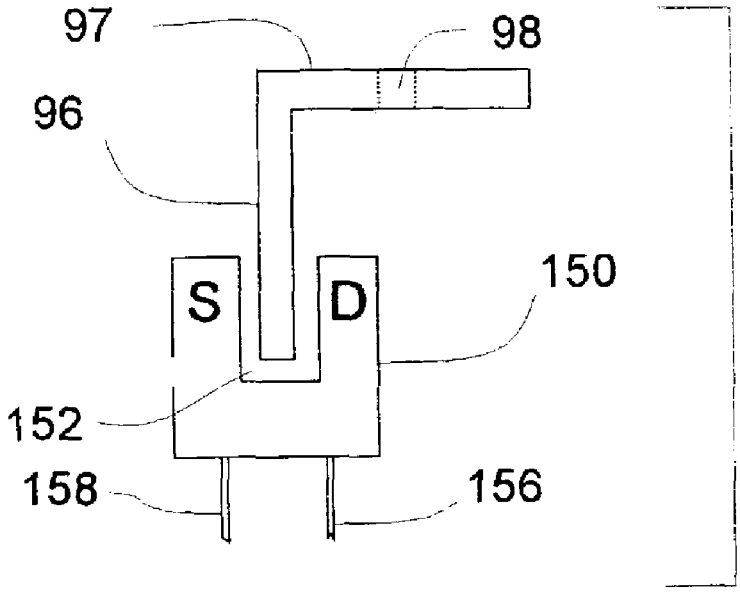
FIG. 4B PRIOR ART

FIGS. 4A and 4B show a prior art slotted photosensor 150 along with an optically opaque flag 96. On one side of a slot 152 in the slotted photosensor 150 is a source of light S (such as a light emitting diode, an LED), and on the other side is a photodetector D. The photodetector can be a simple photodiode, a phototransistor, or a complete photosensing function including one or more amplifiers, a Schmidt trigger, and level adjusting components, for example. For a source S that is an LED, electrical current applied to source leads 158 causes the LED to emit light (or infrared radiation) in the shape of a beam that is aimed to traverse the slot 152 and impinge on the detector D. Electrical leads to the detector D, detector leads 156, are used to drive the detector if the detector requires an applied voltage or current. The detector leads 156 are used to convey a signal from the detector D, the voltage or current state of which signals external circuitry as to whether or not the optically opaque flag 96 is in the slot 152 or not. In FIG. 4A, the flag 96 is not in a position to block the light beam 154 that traverses the slot 152 of the slotted photosensor 150. In FIG. 4B, the flag 96 is located within the slot 152 and blocks the light beam 154. The optically opaque flag 96 includes a flag mounting member 97 that in this example also includes a flag mounting hole 98.

Applications of a slotted photosensor 150 and an optically opaque flag 96 are generally known in the prior art of optical sensing. For example, they are used as a limit switch for controlling the travel of a machine tool, semiconductor processing tool, or other similar positioning machines. In audio and videotape transport applications that use slotted photosensors, the tape itself is often used as the optically opaque flag.

Figure 5A:
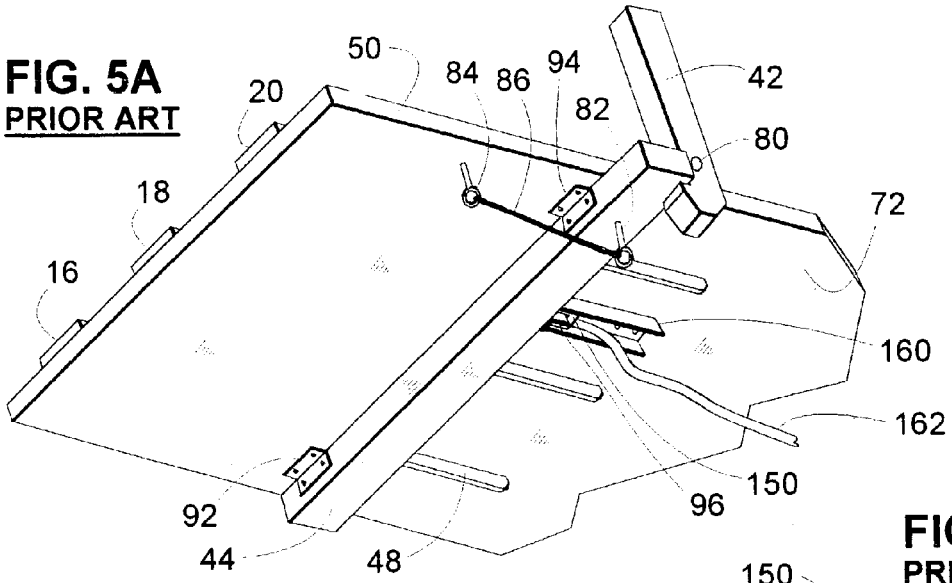
FIG. 5A PRIOR ART
FIGS. 5A and 5C show upward perspective views from beneath the head end of a prior art track and start sensor installation showing a start gate in the closed and open positions respectively.
Figure 5B:
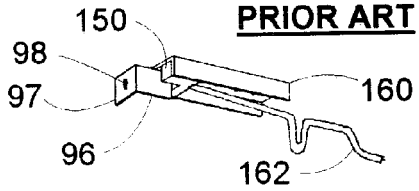
FIG. 5B PRIOR ART
FIGS. 5B and 5D show similar perspectives of just the slotted photosensor (in a mounting bracket) and flag in the same relative orientations as in FIGS. 5A and 5C.
Figure 5C:
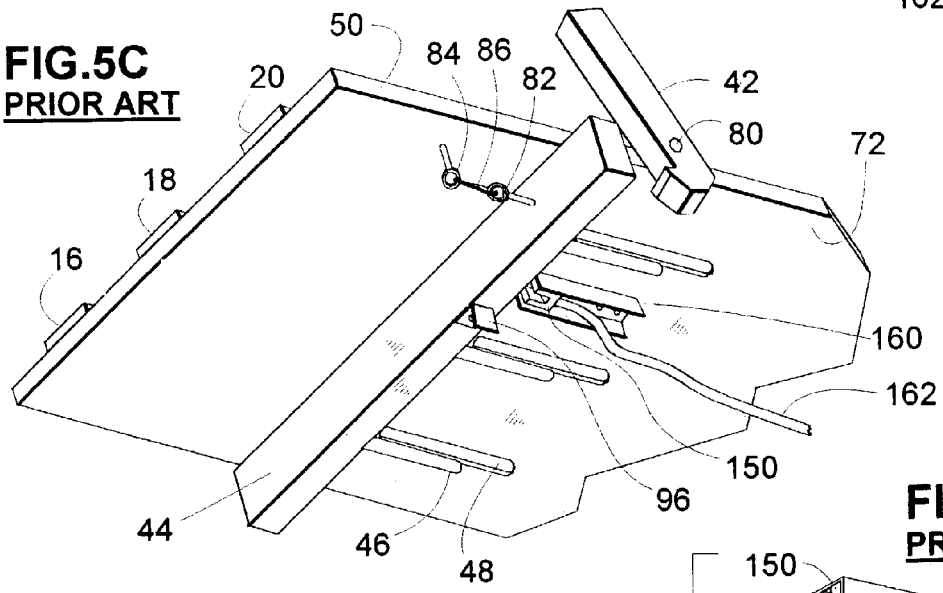
FIG.5C PRIOR ART

FIGS. 5A and 5C show upward perspective views from beneath the head end section 50 of a prior art track with a start sensor installation showing the start bar 44 in the closed and open positions respectively. Callout numbers for elements shown in FIGS. 5A and 5C indicate the identical elements previously discussed above with references to FIGS. 2A through 2D.

Figure 5D:
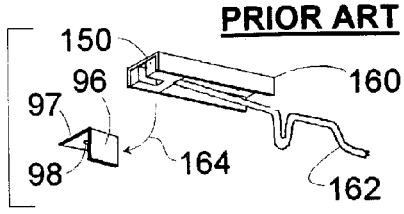
FIG. 5D PRIOR ART

FIGS. 5A and 5C also show a start sensor implemented with a photosensor 150 mounted to the bottom 72 of the track, and an associated optically opaque flag 96, mounted to the start bar 44 of the start gate. For added clarity, FIGS. 5B and 5D show similar perspectives of just the slotted photosensor 150 (inside a mounting bracket 160) along with an associated optically opaque flag 96; these are shown in the same relative orientations as seen in FIGS. 5A and 5C. The start sensor assembly is comprised of the slotted photosensor 150 attached within the mounting bracket 160 and including a able 162 attached to the leads of the slotted photosensor 150. The optically opaque flag 96 is shown including a flag mounting member 97 with a flag mounting hole 98. FIG. 5B illustrates the positioning of the optically opaque flag 96 within the slot of the slotted photosensor 150 when the gate is closed (FIGS. 5A and 5B). FIG. 5D illustrates the positioning of the optically opaque flag 96 when it has been swung along a path 164 out of the slot of the slotted photosensor 150 when the gate is open (FIGS. 5C and 5D). Note the location of the optically opaque flag 96 on the start bar 44 as observed both when the start gate is closed (FIG. 5A) and when the start gate is open (FIG. 5C).

The start sensor 150 shown in FIGS. 5A through 5D is an implementation of the start sensor 100 shown in FIG. 3. The segment of start sensor cable 162 seen in FIGS. 5A through 5D is an implementation of the start sensor interface 110 shown in FIG. 3.

FIGS. 5A and 5C also show the start bar hinges 92 and 94 discussed above in describing FIGS. 2C and 2D. FIGS. 5A and 5C clearly show the mounting of the start bar hinges 92 and 94 to the bottom 72 of the head end section 50 of the track.

And FIG. 5C shows clearly the location, beneath the head end section 50 of the track and below the dowel slots (such as dowel slot 48), of the start gate dowels (or barriers, such as start gate dowel 46) when the start gate bar 44 is in the open position.

Figure 6A:
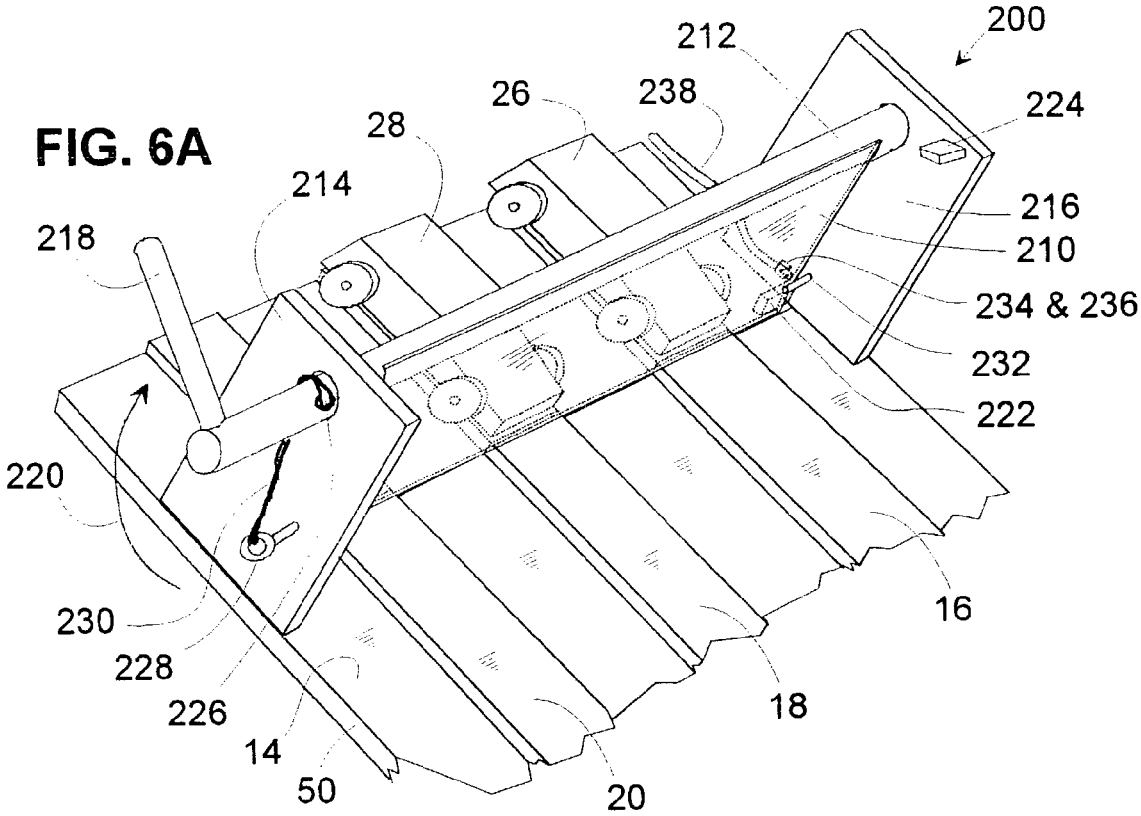
FIGS. 6A and 6B show an improved start gate in closed and open positions respectively.
Figure 6B:
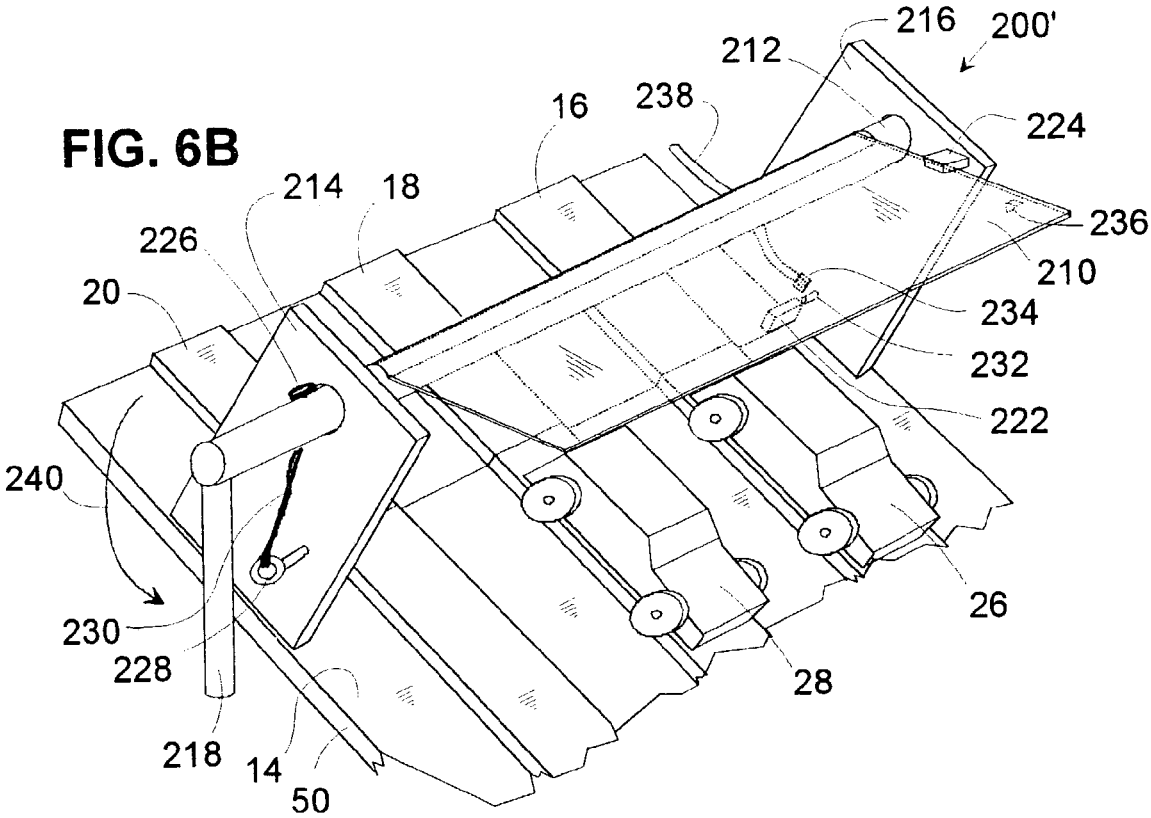
Figure 7:
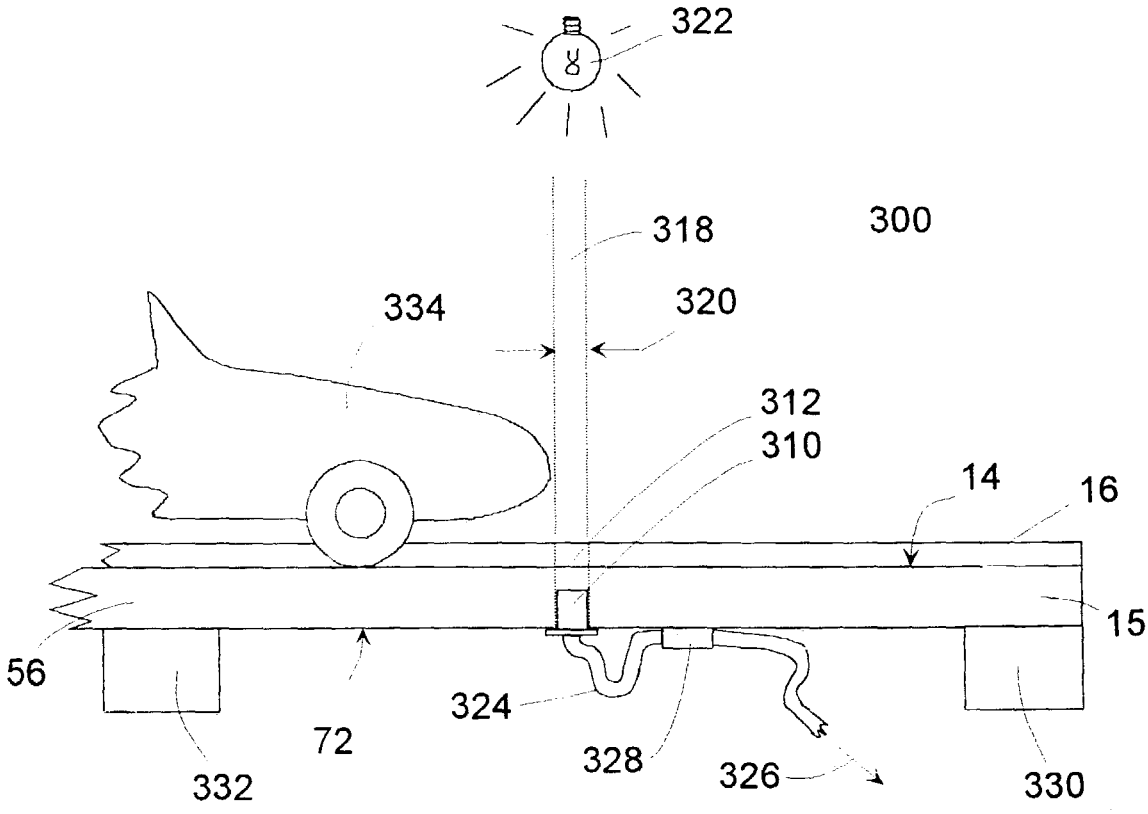
FIG. 7 PRIOR ART
FIG. 7 shows one prior art finish sensor as used at the finish line of a race, wherein a photosensor receives light from an overhead lamp, and a racecar crossing the finish line of the track interrupts this light from reaching the photosensor.

FIGS. 6A and 6B show an upswinging start gate in closed and open positions respectively 200 and 200'. This new and improved start gate has advantages over the prior art. These advantages include: a) dowel slots (such as dowel slot 48) are not required to be made through the track in each lane near the start line, b) the entire start gate assembly can be easily and quickly installed or removed from the track, complete with the start sensor, c) a race can be cleanly started by the pulling of a starter pin, and most importantly d) (as will be discussed further in relation to FIGS. 10A and 10B below) the surface that restrains a racecar at the start line is wide and flat across the entire width of each racecar.

FIGS. 6A and 6B both show the head end section 50 of a track wherein Individual lanes are defined by guide rails 16, 18, and 20 to guide racecars such as the two shown 26 and 28 to roll on a race surface 14. In FIG. 6A, the racecars (such as 26 and 28) rest against a start gate barrier member 210 in the start position. In FIG. 6B, the start gate barrier member 210 has been swung upward and forward out of the way of the racecars 26 and 28. The direction 220 that a start gate handle 218 swings to be place in the closed position is shown in FIG. 6A. The direction 240 that a start gate handle 218 swings in accompanying the opening motion is shown in FIG. 6B.

Although depicted in FIGS. 6A and 6B as a single transparent and solid sheet, the start gate barrier member 210 could alternatively be structured other ways. For example, the start gate barrier member 210 could be comprised of individual members, one per lane, with air gaps separating them across the width-direction of the track. Also, the start gate barrier member 210 could be made having holes or even be made of a heavy screen material. Both of these alternative structures would reduce the chance of causing disturbances in the form of wind or eddies in the air about the racecars as they start a race.

Both FIGS. 6A and 6B show the start gate barrier member 210 supported by a start gate axle 212. The start gate axle 212 is supported by a hole within each of a first and second support 214 and 216. There are first and second stops 222 and 224 that determine the end positions of the swing path of the start gate barrier member 210 in directions 220 and 240 respectively. A tensioned elastic member 230 (such as a rubber band or spring) is anchored between a first anchor point 226 on the start gate axle 212 and a second anchor point 228 on the first support 214. This tensioned elastic member 230 provides the torque to swing the start gate barrier member 210 quickly from the first stop 222 to the second stop 224. A start gate release mechanism 232 is shown implemented as a pin that holds the start gate barrier member 210 in the closed position against the first stop 222. When this pin 232 is pulled back into the second support 216, the start gate barrier member 210 is freed to be swung upward to the second stop 224 by the torque provided by the tensioned elastic member 230.

Also shown in FIGS. 6A and 6B area start gate photosensor 234, a start gate flag 236, and a cable 238 from the start gate photosensor. The start gate photosensor 234 is shown implemented as a slotted photosensor mounted to the second support 216, and the start gate flag 236 is shown mounted to the start gate barrier member 210. In the closed position of the upswinging start gate 200, the start gate flag 236 is positioned within the slot of the start gate photosensor 234 (see FIG. 6A). In the open position of the upswinging start gate 200', the start gate flag 236 has been removed from within the slot of the start gate photosensor 234 (see FIG. 6B). One skilled in the art can readily appreciate how the start gate photosensor 234 can provide the means to implement a start sensor 100 as shown in the electronic apparatus diagram of FIG. 3.

FIG. 7 shows one prior art finish sensor as used at the finish line of a race, wherein a photosensor receives light from an overhead lamp, and a racecar crossing the finish line of the track interrupts this light from reaching the photosensor. The finish sensor installation 300 shows a photosensor 310 installed within a photosensor mounting hole 312 that is circular and of small diameter. This photosensor mounting hole 312 is directed upward and typically runs through both the track base 15 and the middle of a guide rail 16. Overhead illumination 318 from an overhead lamp 322 provides a useful beam 320 of illumination to the photosensor 310. A cable 324 from the photosensor is shown running in a direction 326 back to a processor. A cable clamp 328 secures the cable 324 to the track bottom 72 of the track base 15 and provides strain relief to the leads of the photosensor 310. A first and a second support member 330 and 332 are provided to support the track base 15 up above a supporting floor. Finally, a racecar 334 in the lane containing the photosensor 310 and photosensor mounting hole 312 is shown positioned where it would be just before interrupting the beam 320 of illumination and with its wheels on the race surface 14.

The primary advantage of the prior art finish sensor installation 300, shown in FIG. 7, is its simplicity. The photosensor 310 can be an ordinary photodetecting diode. The photosensor mounting hole 312 is small and visually unobtrusive, requiring removal of very little material from the track. One of the disadvantages, however, is the need to provide an overhead lamp 322. A major disadvantage of this type of finish sensor installation 300 is that racecars with different shapes at their leading edges (at the fronts of the racecars) cast differently shaped shadows as they pass over the photosensor 310, and this causes timing of the photosensor signals to vary. Similarly, illumination from sources of light other than the overhead lamp 322 can also affect the timing of the photosensor signal to the processor. As racecar speed at the finish line is typically almost 16 km/hr or 0.447 cm/msec (approximately 10 miles per hour or 0.176 inch/msec), a racecar can travel just under ½ of a centimeter in a millisecond (just under 3/16 of an inch in a millisecond). Since the width of a typical photosensor 318 is on the order of a few millimeters (approximately ⅛ inch), relative positions of racecars crossing the finish line defined by beams such as beam 320 can ideally be discriminated to within approximately one millisecond or less than 0.5 cm (or less than about 3/16 inch). It is clear that racecar shape and shadows cast by illumination other than the overhead lamp 322 can introduce timing discrepancies greater than one millisecond and therefore greater than 0.5 cm (or more than about 3/16 inch).

Figure 8A:
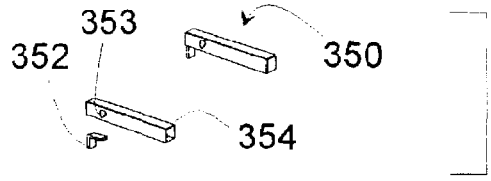
FIG. 8A PRIOR ART
FIGS. 8A through 8D show the components and various stages of assembly of another prior art finish sensor, one that uses a pivoting trip-lever to hold an optically opaque flag relative to a fixed slotted photosensor.
Figure 8B:
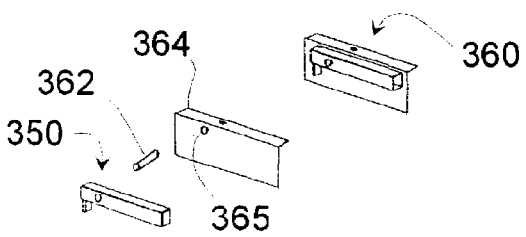
FIG. 8B PRIOR ART
Figure 8C:
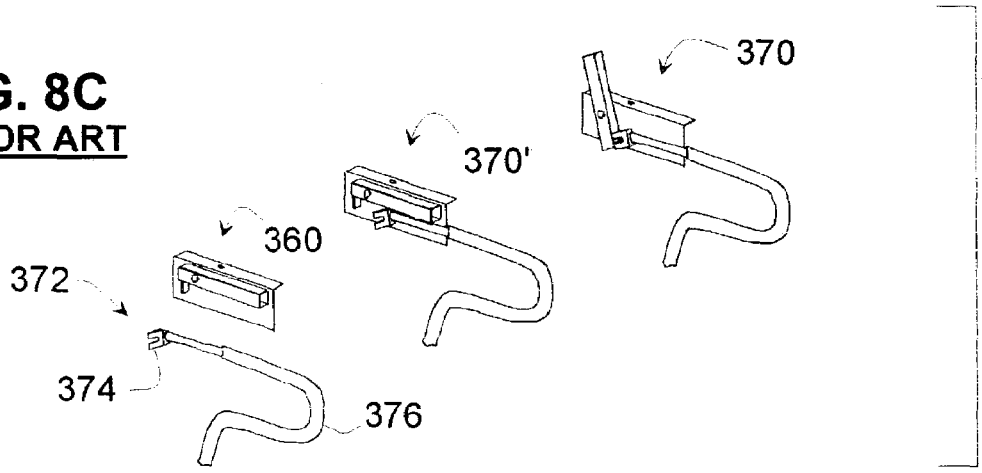
FIG. 8C PRIOR ART
Figure 8D:
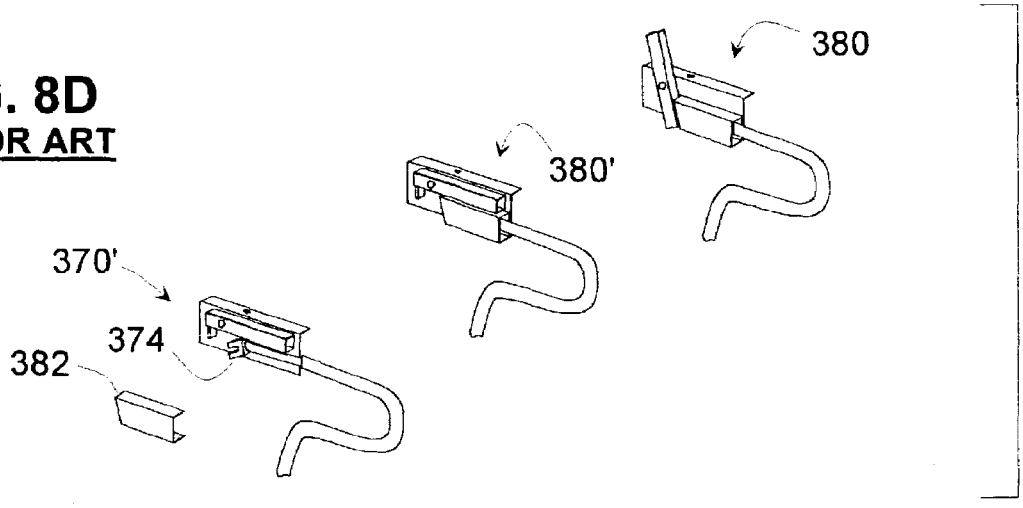
FIG. 8D PRIOR ART

FIGS. 8A through 8D show the components and various stages of assembly of another prior art finish sensor, one that uses a pivoting trip-lever to hold an optically opaque flag relative to a fixed slotted photosensor. FIG. 8A shows a flag and arm subassembly 350 comprised of a flag 352 and an arm 354, wherein the flag is attached near one end of an arm, and wherein the arm has a pivot hole 353 for placement of an axle. FIG. 8B shows a pivoting flag and arm subassembly 360 comprised of the aforementioned flag and arm subassembly 350, mounting bracket 364 with an axle-mounting hole 365, and an axle 362. The axle 362 is anchored in the axle-mounting hole 365, and the flag and arm subassembly 350 is mounted to pivot about the axle 362. A means is included (not shown) to keep the flag and arm subassembly 350 from coming off of the axle 362. FIG. 8C shows an uncovered, closed finish sensor subassembly 370 and an uncovered, open finish sensor subassembly 370'. This uncovered subassembly, in both its closed 370 and open 370' states, is comprised of the aforementioned pivoting flag and arm subassembly 360 and a cabled photosensor subassembly 372 attached to the mounting bracket 364. The cabled photosensor subassembly 372 is comprised of a slotted photosensor 374 and an attached cable 376. Note that the flag 352 is inserted within the slot of the slotted photosensor 374 in the view of the closed finish sensor subassembly 370, and is removed from the slot in the open finish sensor subassembly 370'. FIG. 8D shows a closed finish sensor top assembly 380 and an open finish sensor top assembly 380'. This finish sensor top assembly, in both its closed 380 and open 380' states, is comprised of the aforementioned uncovered subassembly (either 370 or 370') and a cover 382 attached to the mounting bracket 364 to protect the slotted photosensor 374. The function of the cover 382 is also to provide a stop against which the flag and arm subassembly 350 can rest when pivoted to either its closed or open position as illustrated in 380 and 380' respectively.

Figure 9A:
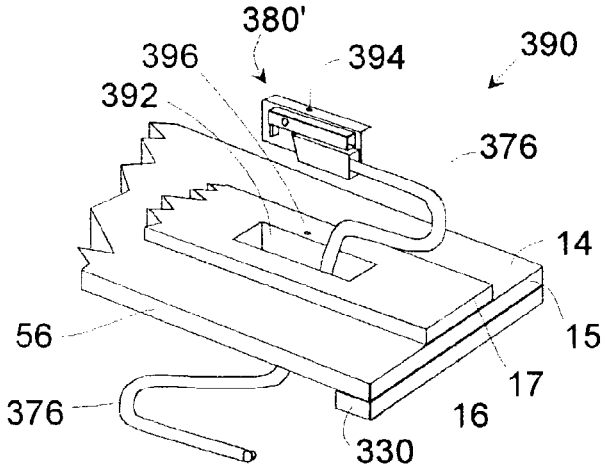
FIG. 9A PRIOR ART
FIG. 9A shows the Installation of the finish sensor of FIG. 8 into a track.

FIG. 9A shows an elevated perspective view 390 of the installation of the finish sensor 380' of FIG. 8D into a rectangular hole 392 cut through the guide rail 16 and track base 15 of one lane near the end of a track. The portion of track pictured here, comprising a track base 15, a guide rail 16, and a first support member 330, is actually a portion of the finish line section 56 of a single-lane track intended for timing the elapsed times of racecars run one-at-a-time. But this view 390 can also be considered as a view of a portion of the finish line section 56 of a multilane track, but showing only a track portion containing a single lane. As seen in FIG. 9A, the relatively larger rectangular hole 392 is substituted for the hole 312 shown in FIG. 7. A bracket screw hole 394 is shown in the mounting bracket 364 of the open finish sensor top assembly 380', and a matching bracket-mounting hole 396 is shown in the guide rail 16 used for fastening the open finish sensor top assembly 380' to the track at the upper surface 17 of the guide rail 16. FIG. 9A also shows the cable 376 from the open finish sensor top assembly 380' as well as the race surface 14.

A disadvantage of the finish sensor top assembly 380 and 380' and its installation 390 shown in FIG. 9A is that the generally rectangular shape of the cross-section of the rectangular hole 392 is more difficult to add to an existing track than the drilled hole 312 shown in FIG. 7. Another disadvantage is the relatively higher cost of the sensor sensor top assembly 380 and 380' compared to the simple photosensor 310 shown in FIG. 7. Advantages of the finish sensor top assembly 380 and 380' and its installation 390 include that it is self-contained and can quickly be removed for storage or remounted for use, and that it is very repeatable or precise, being protected from false triggering from changes in ambient lighting conditions. Also, since the beam of light crossing a slotted photosensor is typically on the order of ¼ millimeter (or 0.010 inch) across, since the pivot lever can provide some motion amplification (about 2×) to magnify motion at a collision point on the arm 354 to a larger motion at the flag 352, and since the motion required to remove the flag 352 from the beam in the slot of the photosensor 374 can be less than 1 or 2 millimeters, the finish sensor top assembly 380 and 380' has an absolute sensitivity on the order of ¼ millimeter or better (<=0.04 inch), equivalent to an absolute finish line event sensitivity at the finish line of better than ¼ of one millisecond. Repeatability, however, can be better than 0.000,1 sec.

Figure 9B:
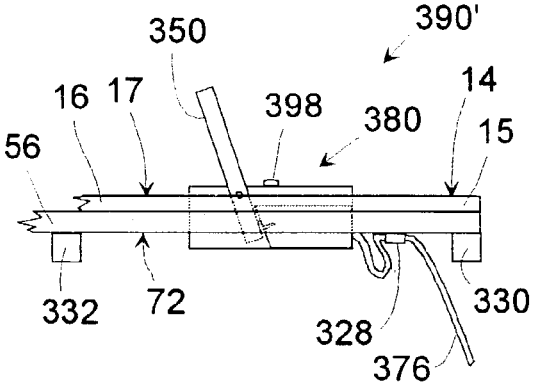
FIG. 9B PRIOR ART
FIGS. 9B and 9C show the installed sensor in the "closed" (or set and ready) position and the "open" or tripped positions respectively.
Figure 9C:
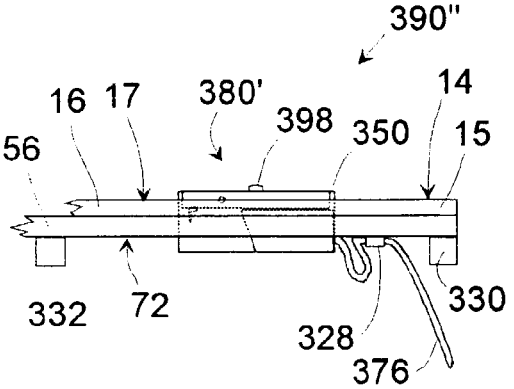
FIG. 9C PRIOR ART

FIGS. 9B and 9C show the installed finish sensor in the "closed" (or set and ready) position and the "open" or tripped position respectively. FIG. 9B shows the installed finish sensor configuration 390' having the flag and arm subassembly 350 rotated to the upright or "closed" position, as when waiting for a racecar to knock it over. FIG. 9C shows the installed finish sensor configuration 390" having the flag and arm subassembly 350 rotated to the down and horizontal position, which is the "open" position as when a racecar has knocked it over in crossing the finish line. In addition to showing all the elements shown in FIG. 9A, FIGS. 9B and 9C also show the closed finish sensor top assembly 380 and the open finish sensor top assembly 380' respectively, the second support member 332 under the track base 15, the head of a bracket mounting screw 398 holding the finish sensor top assembly 380 and 380' to the guide rail top surface 17, the cable 376 to the finish photosensor 380 and 380', and a cable clamp 328 securing the cable 376 to the bottom 72 of the track base 15. Note that the first and second support members 330 and 332 lift the bottom 72 of the track base 15 above any track-supporting surface, thus providing clearance for the bottom of the finish sensor top assembly 380 and 380' and the finish sensor cable 376.

Figure 10A:
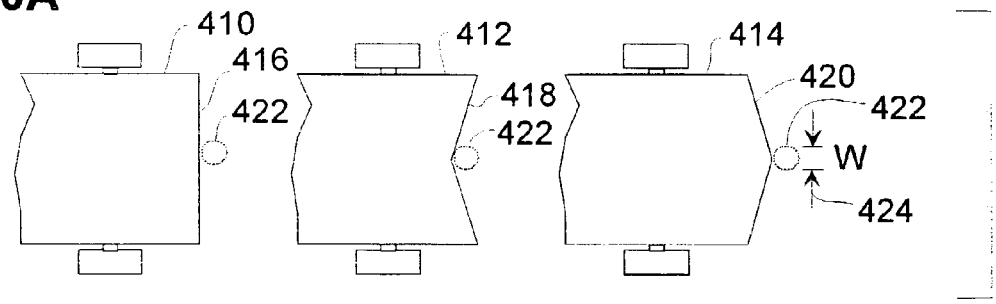
FIG. 10A shows how the relative shapes of the fronts of racecars can affect their positions relative to a contacting or otherwise interrupting cross-section of a vertical beam of light, a start gate dowel, or a trip-lever of a finish sensor.
Figure 10B:
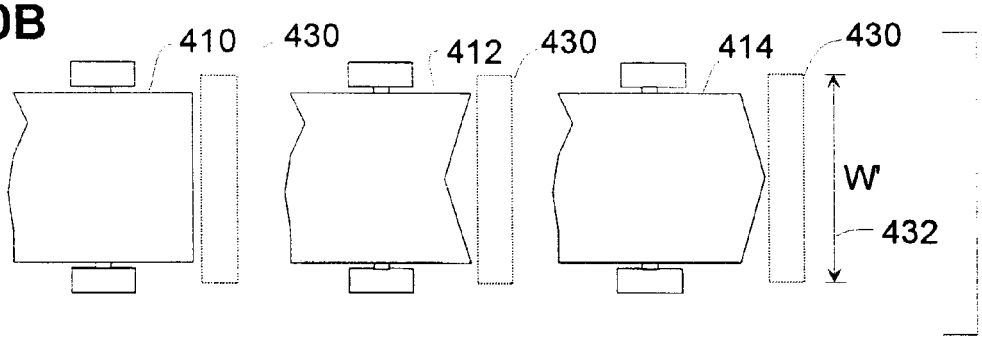
FIG. 10B shows how a flat surface as wide as a racecar can be a more consistent reference, than the circular and relatively narrow cross-section used in FIG. 10A, of the relative position of a racecar upon contact with the front of the racecar.
Figure 10C:
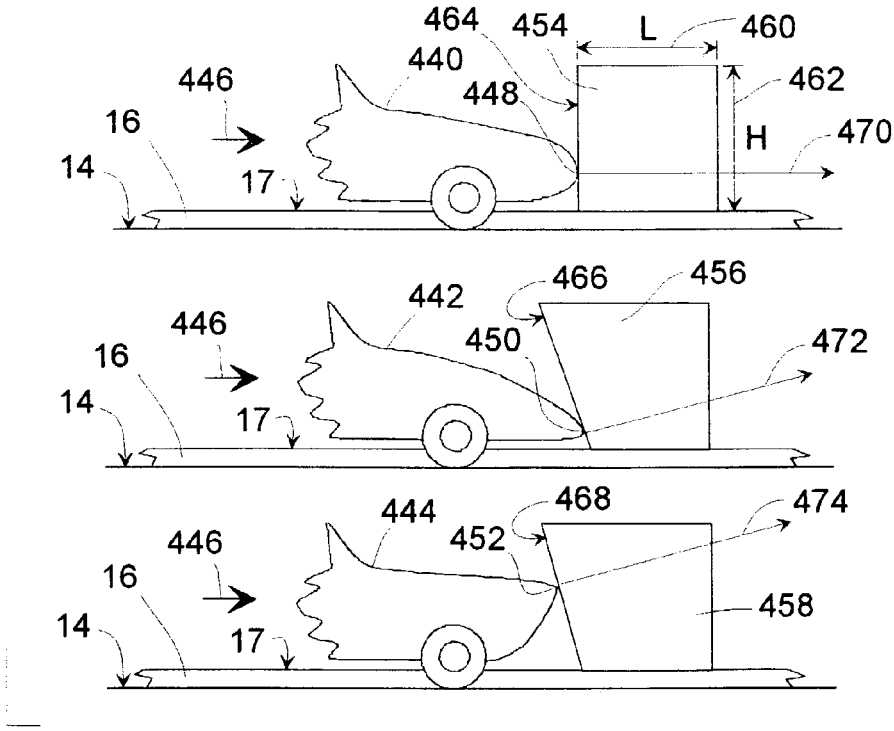
FIG. 10C shows how the shape of a moving racecar, together with the orientation of a collision surface of an obstacle, can determine both finish times and an angle of collision force, the later affecting the trajectory a free-body obstacle would take upon collision with the racecar.

FIG. 10A shows how the relative shapes of the fronts of racecars can affect their positions relative to a contacting or otherwise interrupting cross-section of a vertical beam of light, a start gate dowel, or a pivot arm or trip-lever of a finish sensor. FIG. 10B shows how a flat surface as wide as a racecar can be a more consistent reference, than the circular and relatively narrow cross-section used in FIG. 10A, of the relative position of a racecar upon contact with the front of the racecar. FIG. 10C shows how the shape of a moving racecar, together with the orientation of a collision surface of an obstacle, can determine both finish times and an angle of collision force, the later affecting the trajectory a free-body obstacle would take upon collision with the racecar.

FIG. 10A shows a first leading edge 416 on a first racecar 410 as it begins to interfere with a first interfering object 422, wherein the first leading edge 416 is straight along a direction parallel to the plane of the view and perpendicular to the direction the car travels. FIG. 10A also shows a second leading edge 418 on a second racecar 412 as it begins to interfere with the same first interfering object 422, wherein the second leading edge 418 is not straight as with racecar 410 but is concave. And FIG. 10A shows a third leading edge 420 on a third racecar 414 as it begins to interfere with the same first interfering object 422, wherein the third leading edge 429 is not straight as with racecar 410 but is convex. The first interfering object 422 is circular in cross-section measured within the plane of the view and has a first width W 424 as measured in a direction parallel to the plane of the view and perpendicular to the common direction the cars travel. The first width W 424 is considerably smaller than the width of a racecar. It can be appreciated from these views that positions of the first racecar relative to the first interfering object 422 would remain constant if the first interfering object were shifted in position along a direction parallel to the plane of the view and perpendicular to the direction the car travels. It can also be appreciated that the same is not the case with the other two racecars 412 and 414. This presents a problem if the first interfering object is used in a means for sensing the start or finish of a race. For example, if the first interfering object represented a start gate centered along the centerline of a guide rail, and also, in a position shifted away from the centerline of the guide rail at the finish line, represented a poorly installed finish sensor, and all other conditions remained equal, the race would be biased in favor of the second racecar 412 and against the third racecar 414, relative to one another and to racecar 410.

FIG. 10B shows the same racecars 410, 412, and 414 as in FIG. 10A, but next to a second interfering object 430 which has a corresponding second width W' 432 measured transverse to the direction the racecars travel and is approximately equal to the widths of the racecars. From observing FIG. 10B, it can be appreciated that the shapes of the leading edges 416, 418, and 420 of the racecars 410, 412, and 414 can bias the outcome of a race one way or another depending on how start gate barriers and finish line sensors, having the form represented by the second interfering object 430, are shifted transversely or not to the centerline of their corresponding guide rails.

FIG. 10C introduces a novel means applicable to an implementation of a sensor to detect when a moving racecar (or other moving object) reaches a certain point of travel, for example as required at a finish line of a race. FIG. 10C shows a fourth leading edge 448 on a fourth racecar 440 as it contacts a first collision surface 464 of a first collision obstacle 454 while traveling in the travel direction 446, wherein the fourth leading edge 448 is vertical as the first collision obstacle 454 rests on a guide rail top surface 17. The wheels of the fourth racecar 440 roll on the race surface 14, and the car is guided in its lane by the guide rail 16. The first collision obstacle 454 is shown as having a length dimension L measured in the fourth racecar's 440 travel direction 446, and as having a vertical height dimension H 462 measured normal to the guide rail top surface 17. A first propulsion direction vector 470 indicates the direction of a resultant collision force on the first collision obstacle 454 from a point (or line) of contact shown to be at the base of the first propulsion direction vector 470.

Similarly, FIG. 10C shows fifth and sixth racecars 442 and 444 colliding (or otherwise contacting) with second and third collision obstacles 456 and 458 respectively. The second and third collision obstacles 456 and 458 have second and third collision surfaces 466 and 468 respectively. These second and third collision surfaces 466 and 468 both lean slightly toward the fifth and sixth racecars 442 and 444 respectively. As a result of this leaning, the second and third propulsion direction vectors 472 and 474 are directed slightly upward from their respective points of contact. It can be seen that the point of contact with the sixth racecar 444 is higher off of the guide rail top surface 17 than that with the fifth racecar 442.

It is to be noted by way of FIG. 10C that where and how racecars contact collision obstacles affects the directions and shapes of respective trajectories those obstacles take after collisions with the racecars, and how those obstacles are or are not caused to tumble or spin. One can easily appreciate that vertical collision surfaces will not bias race times, but that leaning ones can bias them under certain conditions. Those conditions include the shapes of the leading edges of racecars and whether or not start gate barrier surfaces lean the same way as collision surfaces of collision obstacles used as components of finish sensors. So it is best not to use collision surfaces that lean away from the vertical on a horizontal section of racetrack.

Figure 11:
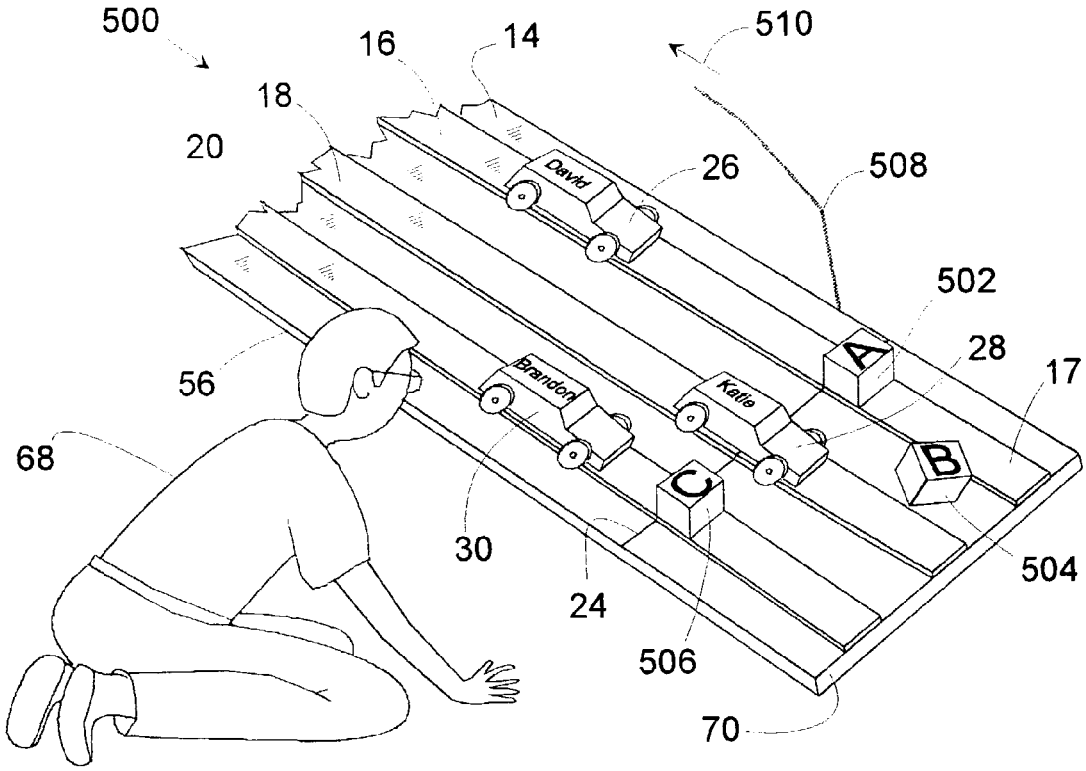
FIG. 11 shows special collision obstacles according to the current invention being used as part of finish-line sensor apparatuses at the finish line of a track for toy racecars, wherein a racecar crossing the finish line along a guided lane of a track collides with a block-shaped collision obstacle and propels it down the track, thus adding excitement to the race.

FIG. 11 shows special collision blocks (collision obstacles) according to the current invention being used as part of finish-line sensor apparatuses at the finish line of a track for toy racecars. A racecar crossing the finish line along a guided lane of a track collides with a block-shaped obstacle and propels the obstacle down the track and thus adds excitement to the race. FIG. 11 does not show finish sensors that are installed in the lanes of the track at the finish line to sense the presence or absence of the collision obstacles (sensor-cooperative collision obstacles) set down at the finish line before beginning each race. These sensors will be shown and described later with reference to the figures that follow FIG. 11.

FIG. 11 shows an elevated perspective view of a race in progress 500 with racecars 26, 28, and 30 all on the finish line section 56 of a racetrack. Three racecars 26, 28, and are shown traveling toward the track end 70 and being guided by respective guide rails 16, 18, and 20 over the race surface 14. Only the lead racecar 28 has reached the finish line 24. A judging person 68 is crouched near to the finish line 24 to witness the order in which the racecars 26, 28, and 30 reach the finish line 24. The judging person 68 can use the lane locations on the track as the means of assigning which racecars cross the finish line 24 in sequence as "first place", "second place", and "third place". Or the judging person 68 can use other unique identifications associated with the racecars, such as the names on the racecars themselves, such as "Katie", "Brandon", and "David" as illustrated. Racecars 26 and 30 have not yet reached the finish line 24. First and third collision obstacles 502 and 506 respectively are shown resting (free standing) on guide rail top surfaces (such as 17 for guide rail 16) of guide rails 16 and 20. A second collision obstacle 504 is shown tumbling (free) down the track toward the track end 70 after having been collided into at the finish line 24 by the "first place" racecar 28. As a convenience to the users, and to assure repeatability of finish sensor responses, the collision obstacles 502, 504, and 506 have labels "A", "B", and "C" printed on them for identification and their assigned correspondences with lanes. A bundle of sensor cables 508 is shown routed underneath the track toward finish sensors (not shown) installed in the lanes of the track at the finish line 24. The sensor cables 508 continue in the direction 510 back to an electronic apparatus not shown but as depicted in FIG. 3.

Figure 12A:
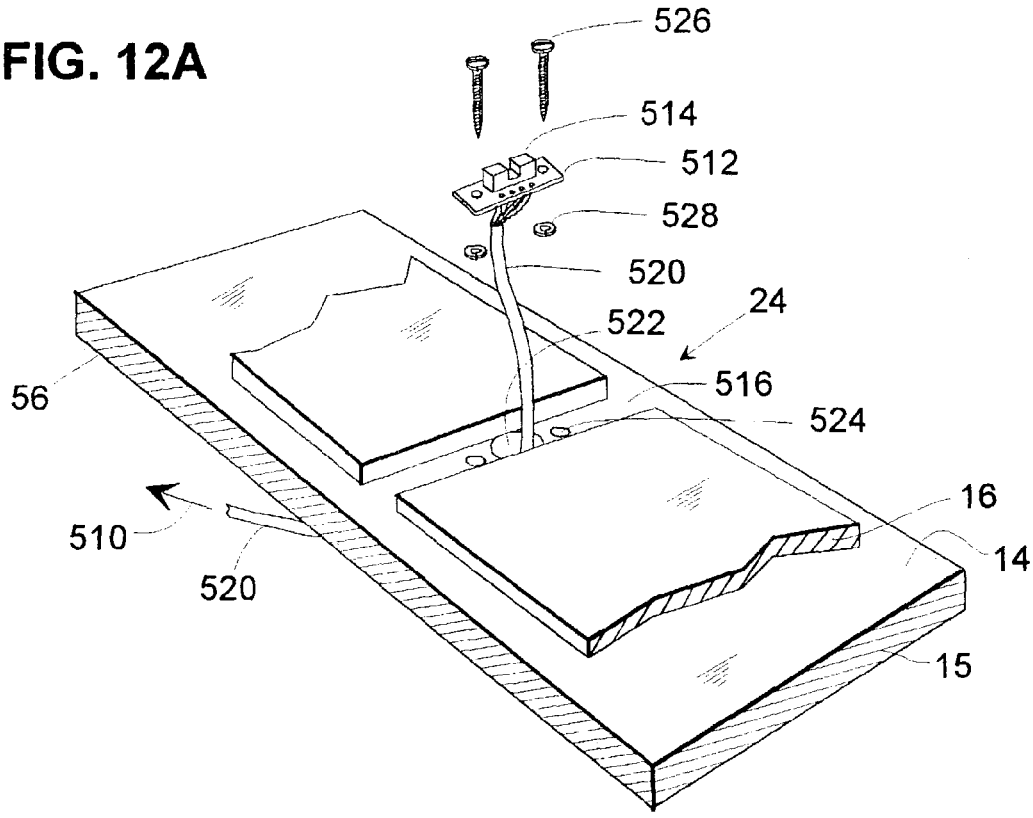
FIG. 12A shows a slotted photosensor mounted to a small printed circuit board (PCB) being installed, according to the current invention, at a finish line in a lane of a track.
Figure 12B:
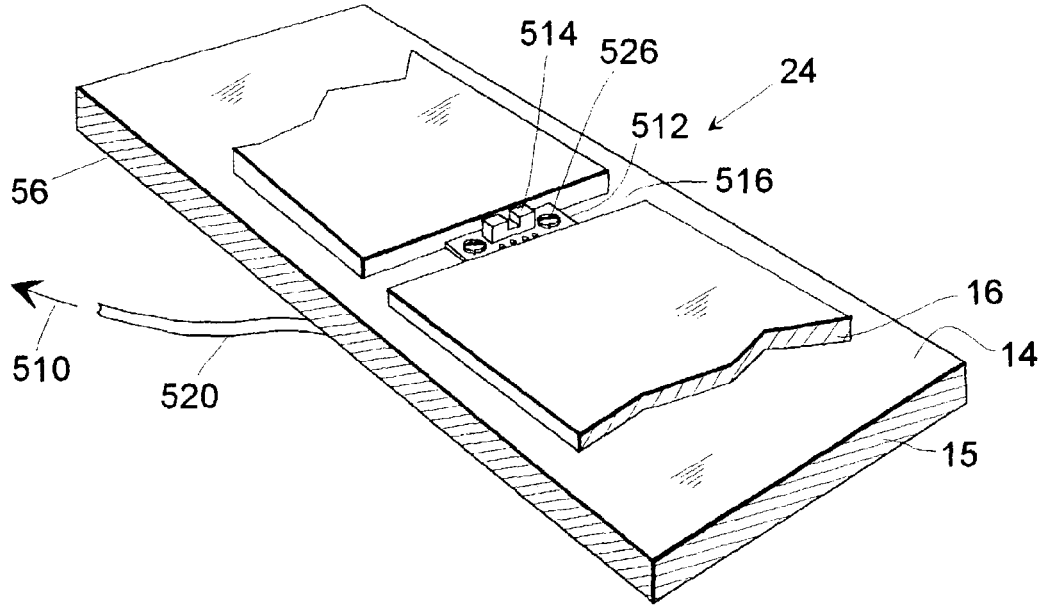
FIG. 12B shows the finished installation located in a gap of the guide rail that is used to define the lane.

FIGS. 12A and 12B are elevated perspective views of a one-lane portion taken about a finish line section 58 of a racetrack. FIGS. 12A and 12B show what is below the collision blocks 502, 504, and 506 when they are set-up before a race at the finish line 24. FIG. 12A shows a miniature sized, slotted finish sensor 514 mounted to a finish sensor printed circuit board (PCB) 512. This subassembly of the slotted finish sensor 514 and PCB 512 is being installed, as shown according to one application of the current invention, at a finish line 24 and within a gap 516 in a guide rail 16 that defines a lane of a track. A pass-through hole 522 is cut into the track base 15 for the cable 520 attached to the PCB 512. The cable can be seen sticking out from underneath the track base 15 and routed in the direction 510 to an electronic apparatus (not shown) as described with reference to FIG. 3. Two additional holes 524 are shown in the track base 15 for aligning with mounting holes in the PCB 512 and receiving and securing two PCB mounting screws 526. As will be described with reference to later figures, two spacer washers 528 can be used to stand the PCB 512 a little ways above the racing surface 14 of the finish section 56 of the track. FIG. 12B shows the finished installation.

Figure 13A:
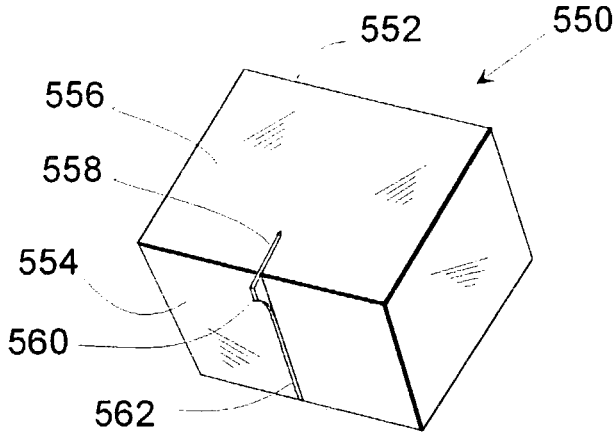
FIG. 13A shows a collision obstacle according to the current invention, wherein the collision obstacle is a block that includes an optically opaque flag appended to its bottom surface near to an intended collision surface.

FIG. 13A shows a collision obstacle assembly 550, according to the current invention, comprising a collision surface 556, an optically opaque flag 560 to serve as a sensor-interaction feature, and a collision block 552 to serve as a base to support the collision surface 556 and the optically opaque flag 560 (the sensor-interaction feature). The optically opaque flag 560 is located on the bottom surface 554 of the block 552 near a common edge with the collision surface 556. In the implementation shown, a flag base member 562 is inserted and lodged within a slit 558 within the collision block 552 to support the optically opaque flag 560. The flag base member 562 and its optically opaque flag 560 can be manufactured as a single element by cutting a single piece from a thin sheet of plastic. An edge of the flag base member 562 inserted within this slot is shown as a dashed line in FIGS. 13B and 13C. It is best to manufacture the collision block 552 of plastic foam or rubber foam in order to give it a low inertial mass. If the collision block 552 has a low inertial mass, it will have a minimum effect on a racecar's momentum after reaching the finish line 24 and will propel the collision block 552 away from a free standing position at the finish line 24 with a maximum velocity. This will permit the slotted finish sensor 514 to have a short (fast) response time. Optionally Adding additional mass to the collision block 552, however, can dampen the momentum of racecars in order to protect them from damaging collisions with hard objects beyond the finish line. Making the collision block 552 from an elastic foam with a resiliency common to foam used in seat cushions will enable it to be moved off of the finish line 24 after a minimum of collision surface compression (less than 3 mm or about ⅛ inch of compression of the collision surface 556).

Figure 13B:
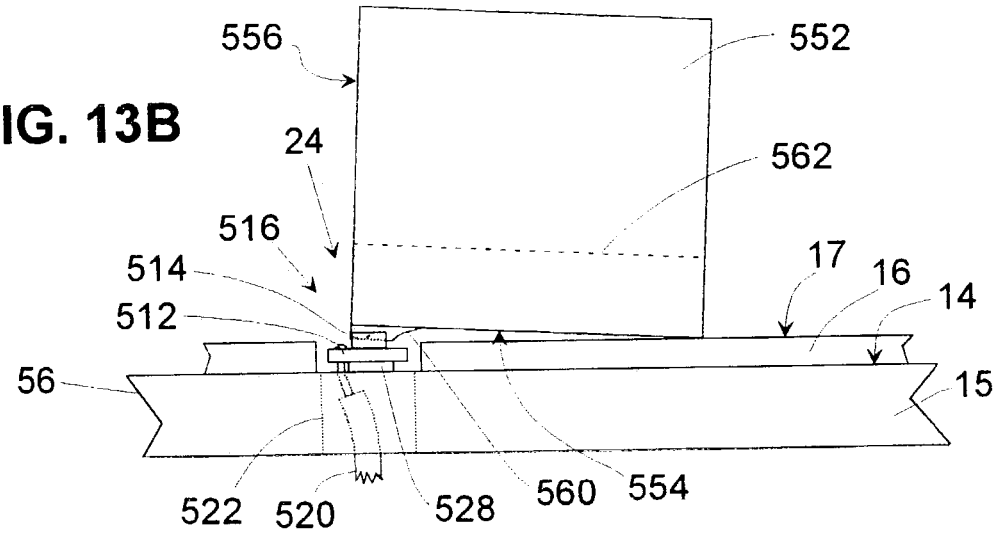
FIGS. 13B and 13C show the flag positioned in the slot of the slotted finish sensor shown in FIGS. 12A and 12B and show alternative positions for the slotted finish sensor.
Figure 13C:
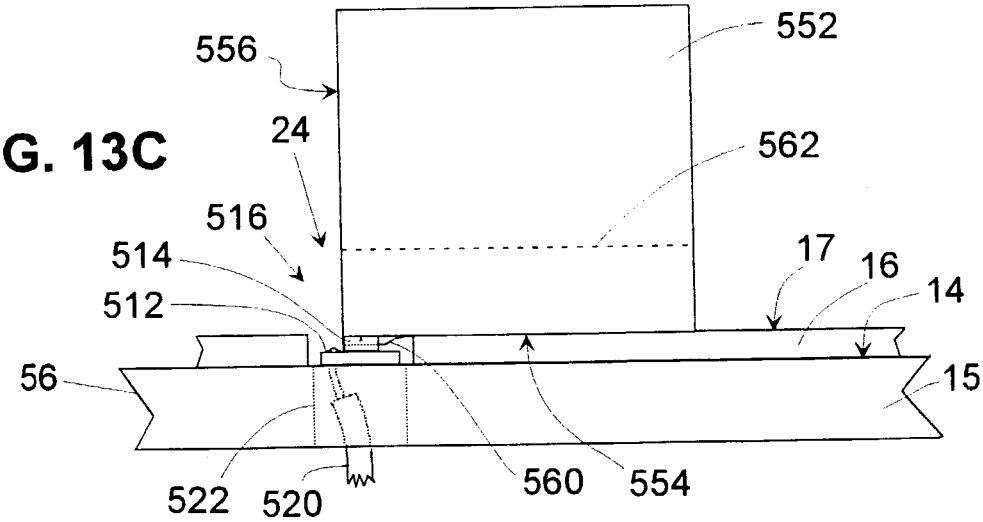

In FIGS. 13B and 13C, alternative implementations are shown for a sensing apparatus, wherein the collision obstacle 550 is made to work with a sensing device (an object-sensing device) mounted in the track, and wherein the sensing device is a slotted finish sensor. These two implementations differ in the height with which the slotted finish sensor 514, with its printed circuit board (PCB) 512 (shown also in FIGS. 12A and 12B), is mounted above the race surface 14. FIG. 13 B shows the slot of the slotted finish sensor 514 supported to stick up just above the guide rail top surface 17. FIG. 13C shows the slot of the slotted finish sensor 514 at a lower position at or below the guide rail top surface 17. The additional height of the slotted finish sensor 514 in FIG. 13B is effected by inclusion of spacer washers 528 (as also shown in FIG. 12A) under the finish sensor PCB 512. The advantage of the implementation shown in FIG. 13B is that the optically opaque flag 560 will not interfere with the edges of the gap 516 when a racecar moves the collision obstacle assembly 550 off of its position at the finish line 24. The advantage of the implementation shown in FIG. 13C is that the collision block 556 sits more fully and securely on the guide rail top surface 17 before a race. However, there is a small disadvantage with the implementation shown in FIG. 13C. This disadvantage is that the leading edge of the optically opaque flag 560 requires a tapered shape (as shown) to reduce obstruction and friction with the edge of the gap 516 as a racecar moves the collision obstacle assembly 550 off of the finish line 24 and.

FIGS. 13B and 13C illustrate the cooperative operation of the collision obstacle assembly 550 with the slotted finish sensor 514 to form a complete finish line sensor means according to the current invention. The gap 516 where the slotted finish sensor 514 is located is in the guide rail 16 within the finish line section 56 of the track. Within this gap 516, the passthrough hole 522 through the track base 15 allow the cable 520 to be run beneath the track away from interfering with racecars. The side of the slotted finish sensor 514 that is nearest to the head-end section 50 (shown in FIG. 1) of the track is aligned along the intended position of the finish line 24. And the collision surface 556 is positioned over the finish line 24. The location of the optically opaque flag 560 relative to the collision surface 556 is then such as to place the optically opaque flag 560 within the slot of the slotted finish sensor 514 when the collision obstacle assembly 550 is set up in place before a race. Before a race, the collision obstacle assembly 550 is made to rest on the guide rail top surface 17. In the implementation shown in FIG. 13B, the collision obstacle assembly 550 also rests by touching down in the slot of the slotted finish sensor 514. In both FIGS. 13B and 13C, the collision obstacle 550 is not held down by any mechanism. Only gravity holds the collision obstacle 550 down at the finish line, permitting it to be remain freestanding while in position at a finish line. All of the implementations of collision obstacles disclosed in this invention are freestanding collision obstacles, free to be knocked off of an associated sensor.

The greatest distinguishing feature that the implementations shown in FIGS. 13A, 13B, and 13C has over others that will be described with references to the figures that follow is that the collision obstacle assembly is inexpensive and easy to manufacture. If the material of the collision block 556 is foam rubber or a plastic foam, then the slitting operation to create the slit 558, and the gluing in place of the flag base member 562 within the slit 558, are quick and easy operations. This implementation also results in a robust structure that can tolerate much abuse and reuse.

Figure 14A:
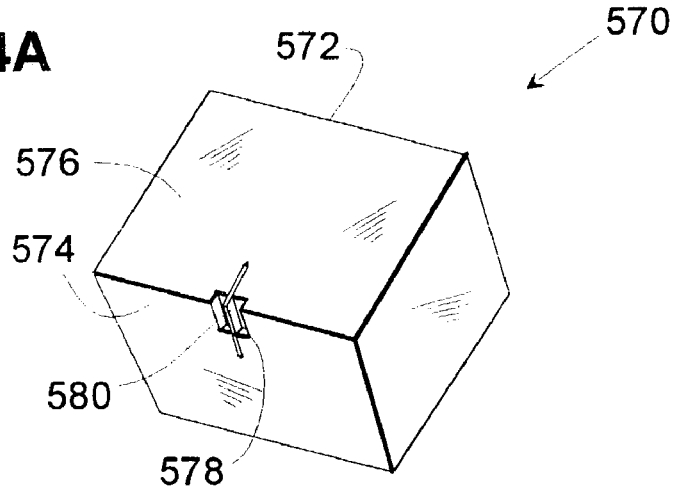
FIG. 14A shows a first alternative configuration of a flag positioning within a cavity of a block, with the flag within the outer dimensional limits of the block itself.

FIG. 14A shows a first alternative configuration for a collision obstacle assembly as 570 that includes the optically opaque flag 580 (with included base element) contained wholly within the outer dimensional limits of the collision block 572 itself. A cavity 578 is formed midway along the line of Intersection between a collision surface 576 and a bottom surface 574. The optically opaque flag 580 (with included base element) is implanted within the collision block 572 such that a flag portion is located within the cavity 578.

Figure 14B:
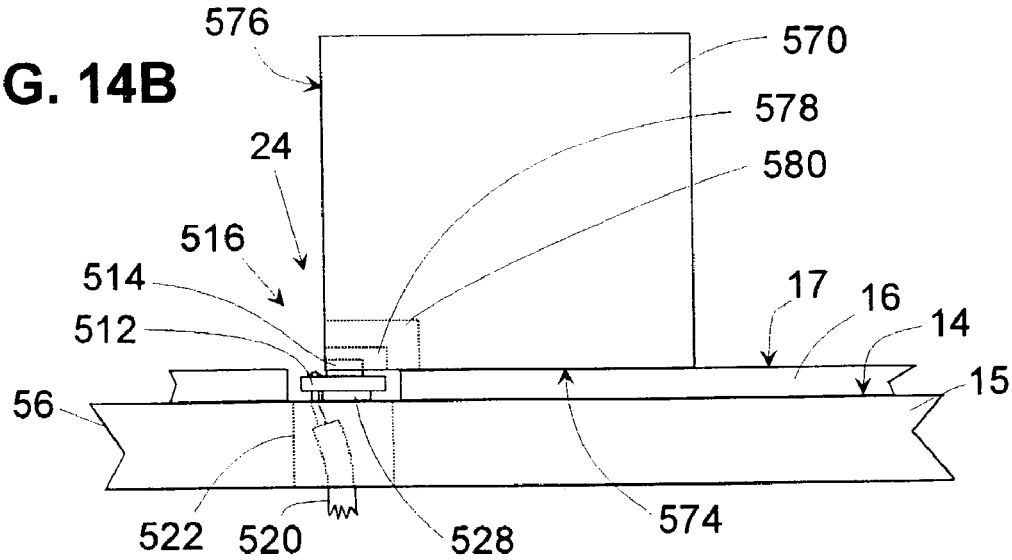
FIG. 14B shows the block (the collision obstacle) with its cavity and flag resting on a guide rail, wherein the slotted finish sensor installed on the track protrudes above the track and into the cavity without preventing the block from resting flush on the track.

FIG. 14B shows the collision obstacle assembly 570, with its cavity 578 and optically opaque flag 580, resting on a guide rail top surface 17 with the optically opaque flag 580 positioned within the slot of a slotted finish sensor 514. This is similar to the positioning described earlier with reference to FIG. 13B. The slotted finish sensor 514 protrudes above the guide rail top surface 17 and into the cavity 578 without preventing the collision block 572 from resting flush on the guide rail top surface 17. The collision surface 576 again is positioned over the finish line 24 where the gap 516 is located in the guide rail 16 above the race surface 14 on the track base 15 of finish section 56 of the track. As before, the slotted finish sensor 514 is mounted on a finish sensor printed circuit board 512 with its cable 520 exiting the bottom of the track through a passthrough hole 522 that is in the track base 15. And spacer washers 528 elevate the slotted finish sensor 514 as before.

Note that in this first alternative configuration, shown in FIGS. 14A and 14B, the collision obstacle assembly 570 rests flush against the guide rail top surface 17, and when a racecar moves it down the track, the optically opaque flag 580 will not interfere with edges of the gap 516. This means of preventing a mechanical interference to the collision obstacle assembly 570 when it is propelled down the track is a clear advantage to this implementation, but making the cavity adds more difficulty to manufacturing the collision block 572.

Figure 15A:
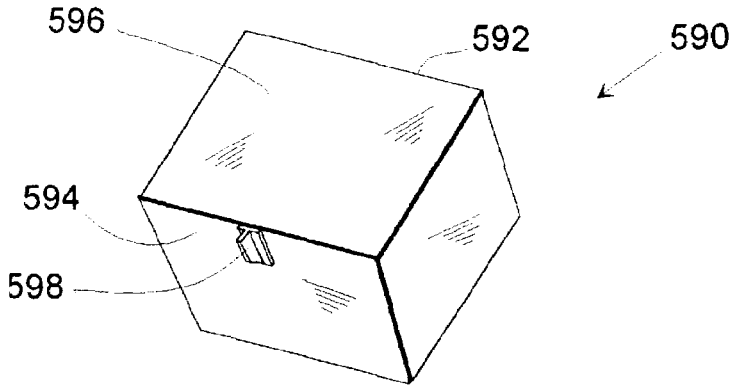
FIG. 15A shows a second alternative configuration of a collision obstacle with a flag, wherein the bottom of the block-shaped obstacle comprises a semi-rigid sheet from which the flag protrudes.

FIG. 15A shows a second alternative configuration of a collision obstacle assembly as 590 that includes an optically opaque flag 598. The optically opaque flag 598 has a "T"shaped cross-section and is fastened to a semi-rigid bottom sheet 594 that provides a bottom surface to the collision block 592 to which it is attached. The optically opaque flag 598 is located near the edge of the semi-rigid bottom sheet 594 where an edge of the latter meets an edge of the collision surface 596.

Figure 15B:
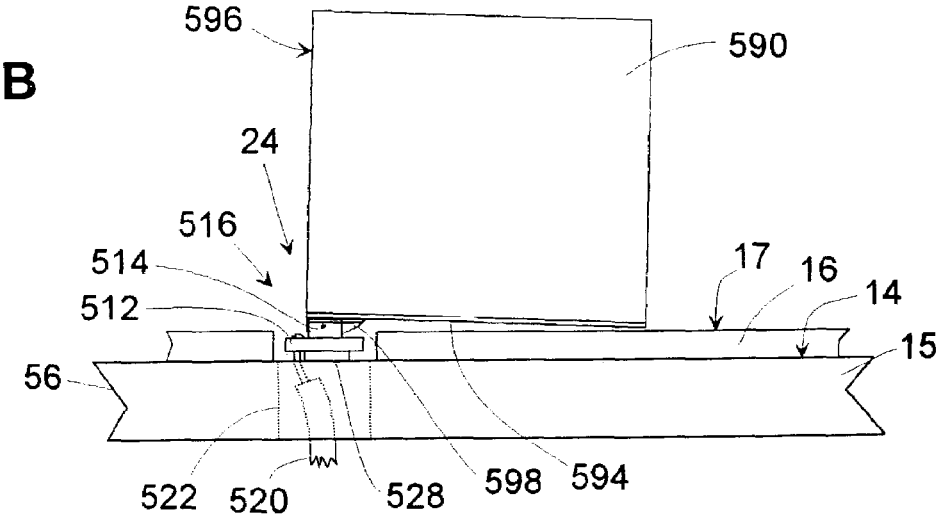
FIG. 15B shows such a collision obstacle resting in place on the track at a finish line, with the flag in a slot of a slotted finish sensor positioned within a gap in a guide rail but above the track.

FIG. 15B shows the collision obstacle assembly 590 resting on a guide rail top surface 17 with the optically opaque flag 598 positioned within the slot of a slotted finish sensor 514. This is similar to the positioning described earlier with reference to FIG. 13B. The slotted finish sensor 514 protrudes above the guide rail top surface 17. The collision surface 576 again is positioned over the finish line 24 where the gap 516 is located in the guide rail 16 above the race surface 14 on the track base 15 of finish section 56 of the track. As before, the slotted finish sensor 514 is mounted on a finish sensor printed circuit board 512 with its cable 520 exiting the bottom of the track through a passthrough hole 522 that is in the track base 15. And spacer washers 528 elevate the slotted finish sensor 514 as before. FIG. 15B shows that the leading edge of the optically opaque flag 598 is tapered to prevent it from catching on the edge of the gap 516 in the guide rail 16.

Figure 15C:
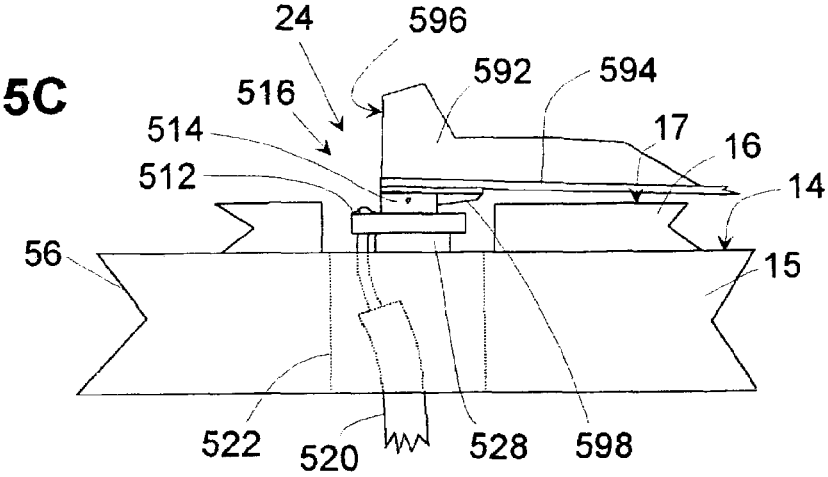
FIG. 15C is an enlarged view of the region about the slotted finish sensor.

FIG. 15C is an enlarged view of the region about the slotted finish sensor 514 showing all of the same elements as in FIG. 15B except that not all of the collision block 592 (and therefore not all of the collision obstacle assembly 590) is in view.

Figure 16A:
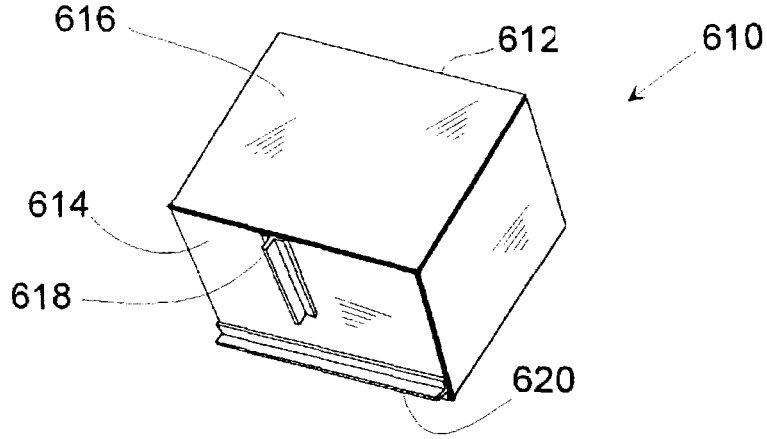
FIG. 16A shows a third alternative configuration of a collision obstacle with flag, wherein the block-shaped collision obstacle is similar to that shown in FIG. 15A, but wherein the flag is elongated to reach beyond the length of a gap in a guide rail of a track lane, and wherein the bottom of the block is equipped with an additional feature to level the block as it sits upon a track.

FIG. 16A shows a third alternative configuration of a collision obstacle assembly as 610 that includes an optically opaque flag 618. The optically opaque flag 618 has a "T"-shaped cross-section and is fastened to a semi-rigid bottom sheet 614 that provides a bottom surface to the collision block 612 to which it is attached. A first end of the optically opaque flag 618 is located near the edge of the semi-rigid bottom sheet 614 where an edge of the semi-rigid bottom sheet 614 meets an edge of the collision surface 616. The opposite end of the optically opaque flag 618 is located closer to the middle of the bottom sheet 614. A leveling bar 620 is fixed to the semi-rigid bottom sheet 614 at an edge opposite the first end of the optically opaque flag 618. Note that the optically opaque flag 618 is similar in cross-section to the optically opaque flag 598 shown in FIG. 15A, but has a longer length and does not require the tapered leading edge. Note that the leveling bar 620 helps to keep the semi-rigid bottom sheet 614 of the collision obstacle assembly 610 co-parallel with the guide rail top surface 17 (see FIG. 16B described next). For a collision block 612 having its collision surface 616 at least approximately perpendicular to the semi-rigid bottom sheet 614, proper choice for the cross-section size of the leveling bar 620 can orient the collision surface 616 vertically over a horizontal race surface 14 (as shown).

Figure 16B:
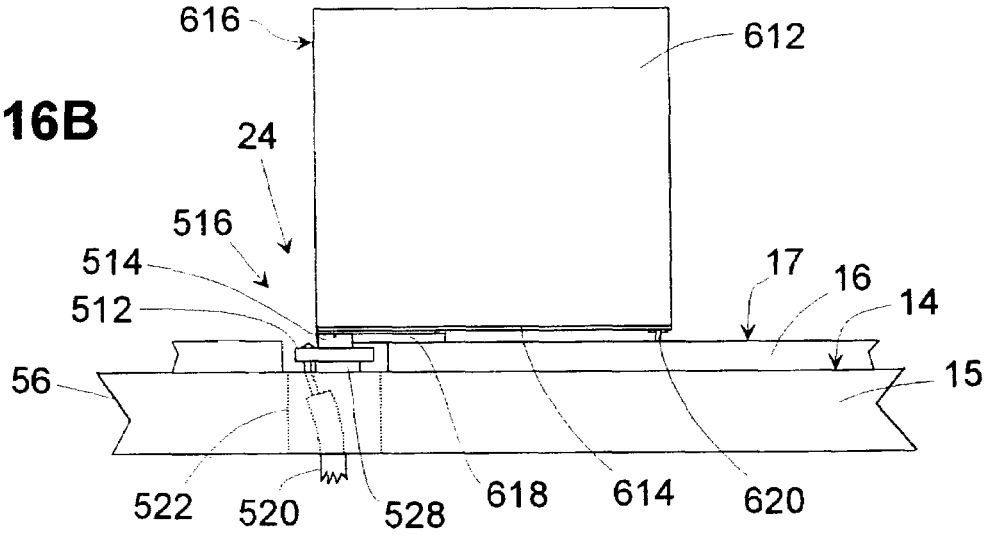
FIG. 16B shows how such a block sits on a slotted finish sensor that is positioned within a gap of a guide rail in the lane of a track.

FIG. 16B shows the collision obstacle assembly 610 resting on a guide rail top surface 17 with the optically opaque flag 618 positioned within the slot of a slotted finish sensor 514. This is again similar to the positioning described earlier with reference to FIG. 13B. The slotted finish sensor 514 protrudes above the guide rail top surface 17. The collision surface 616 again is positioned over the finish line 24 where the gap 516 is located in the guide rail 16 above the race surface 14 on the track base 15 of finish section 56 of the track. As before, the slotted finish sensor 514 is mounted on a finish sensor printed circuit board 512 with its cable 520 exiting the bottom of the track through a passthrough hole 522 that is in the track base 15. And spacer washers 528 elevate the slotted finish sensor 514 as before. FIG. 16B shows that the extended length of the optically opaque flag 598 assures that it will not interfere with the edge of the gap 516 in the guide rail 16 when a racecar strikes the collision surface 616.

Figure 16C:
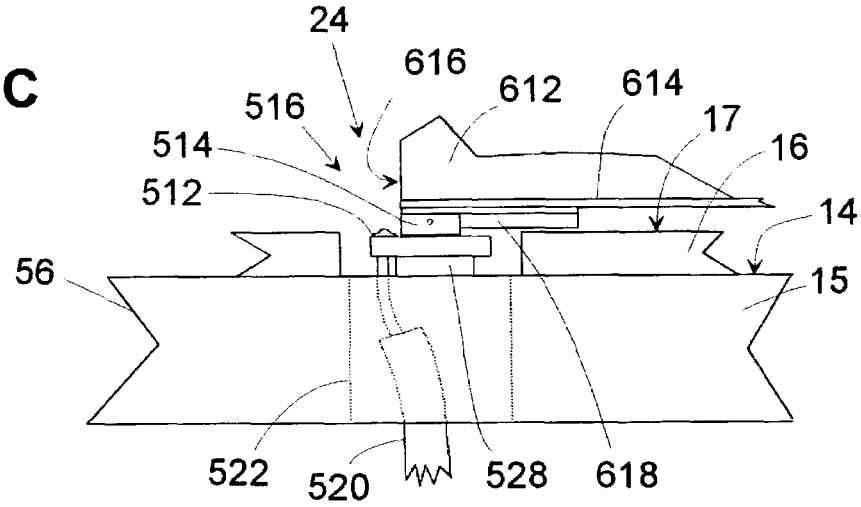
FIG. 16C is an enlarged view of the region about the slotted finish sensor.

FIG. 16C is an enlarged view of the region about the slotted finish sensor 514 showing all of the same elements as in FIG. 16B except that not all of the collision block 612 (and therefore not all of the collision obstacle assembly 610) is in view.

Figure 17A:
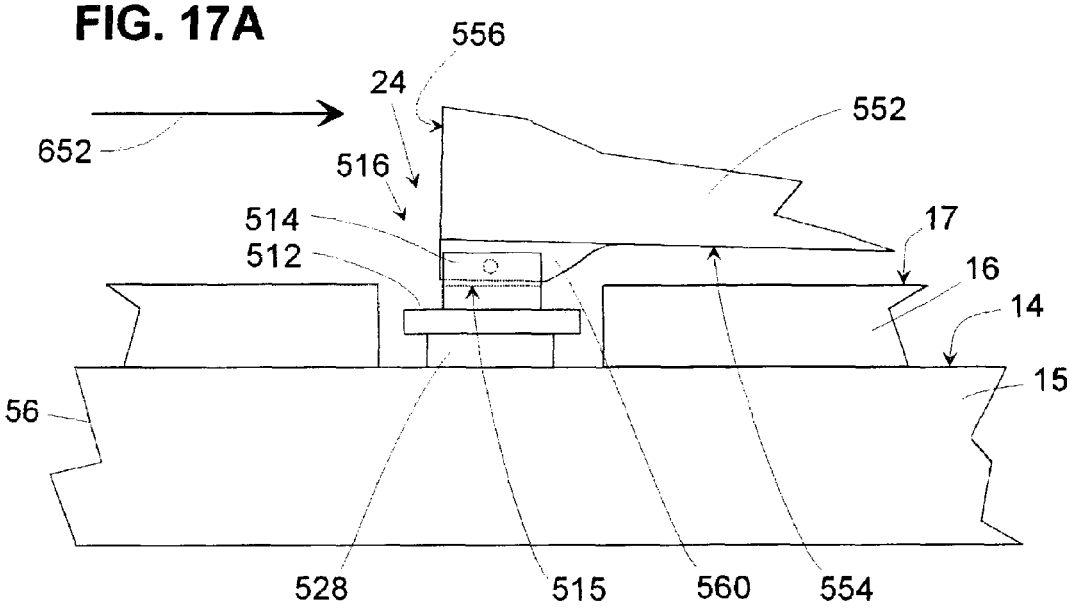
FIGS. 17A and 17B show enlarged views of the region about the finish sensor shown in FIGS. 13B and 13C. However.
Figure 17B:
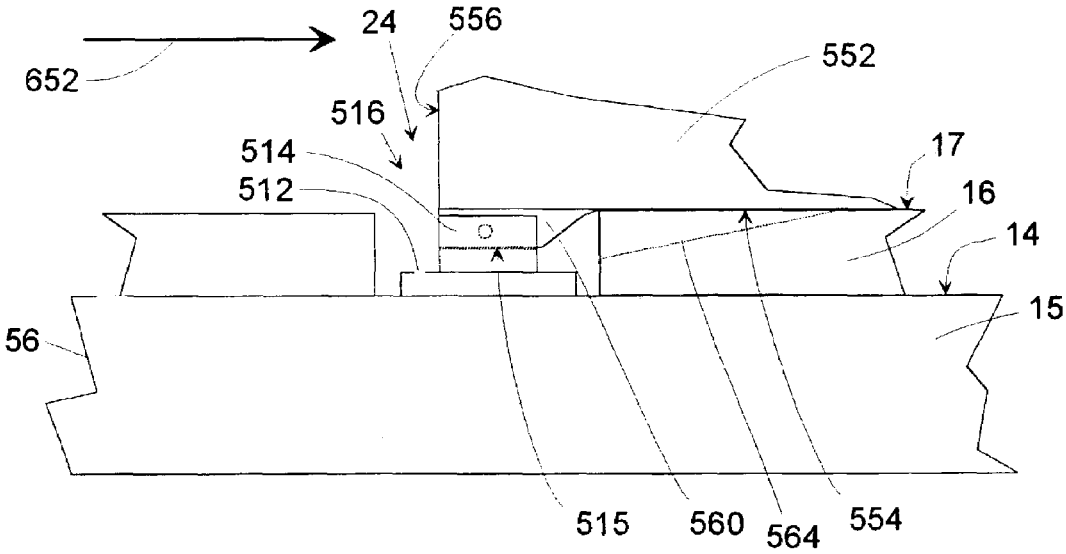

FIGS. 17A and 17B show enlarged views of the region about the slotted finish sensor 514 shown in FIGS. 13B and 13C. FIG. 17B also shows a bottom contour of a depth-tapered groove 564, configured within the guide rail 16 from the guide rail top surface 17. This depth-tapered groove 564 is to clear the optically opaque flag 560 as the collision obstacle assembly 550 (see FIG. 13A) is propelled down the track by collision with a racecar traveling in the direction of racecar travel 652. Where it opens into the gap 516, this depth-tapered groove 564 has a depth that extends below the bottom level of the slot in the slotted finish sensor 514. As the depth-tapered groove 564 extends towards the end of the track 70 (see FIG. 11), its depth may gradually decreases to zero over a length of a few centimeters (about an inch or so). A depth-tapered groove 564 is not required in the configuration shown in FIG. 17A where the photosensor slot bottom 515 sits at or above the guide rail top surface 17. But a depth-tapered groove 564 is desired in the configuration shown in FIG. 17B where the top of the slotted finish sensor 514 sits at or below the guide rail top surface 17.

Figure 18A:
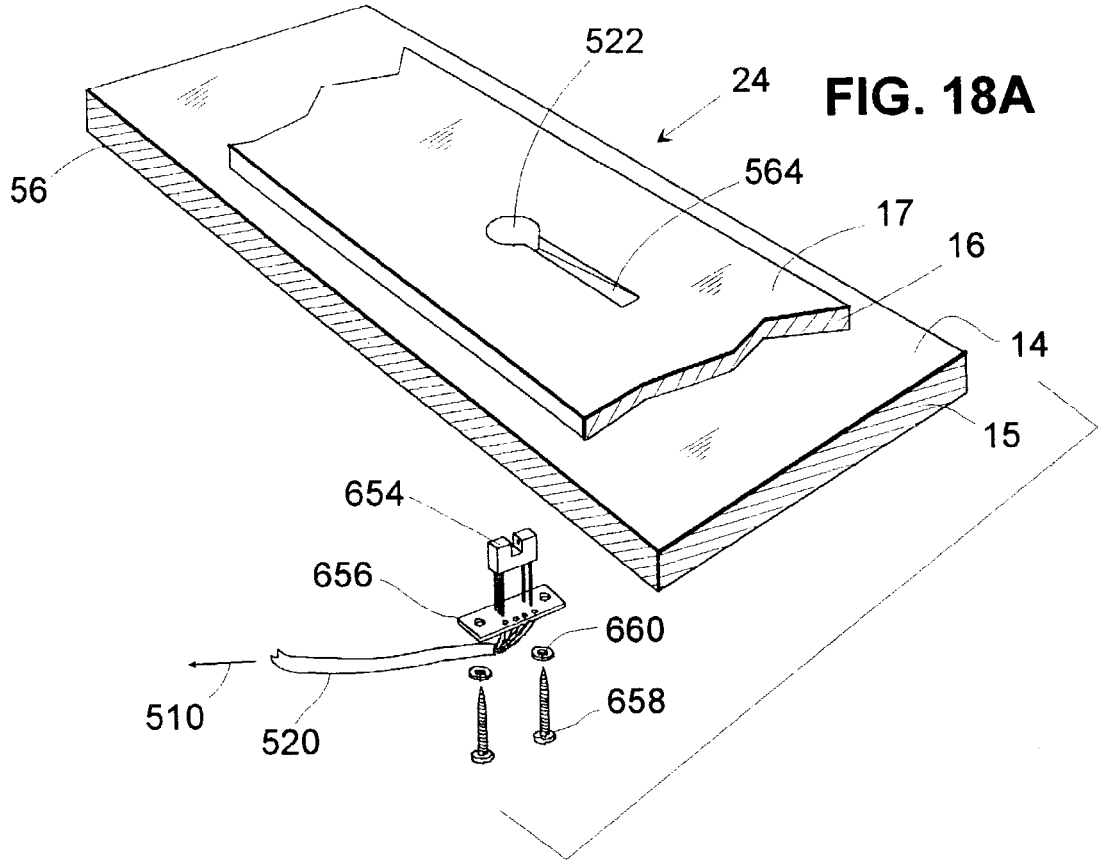
FIGS. 18A and 18B show elevated perspective views of an alternative configuration for assembling a slotted finish sensor to a lane of a track, wherein a slotted photosensor is mounted from beneath a track rather than from above.
Figure 18B:
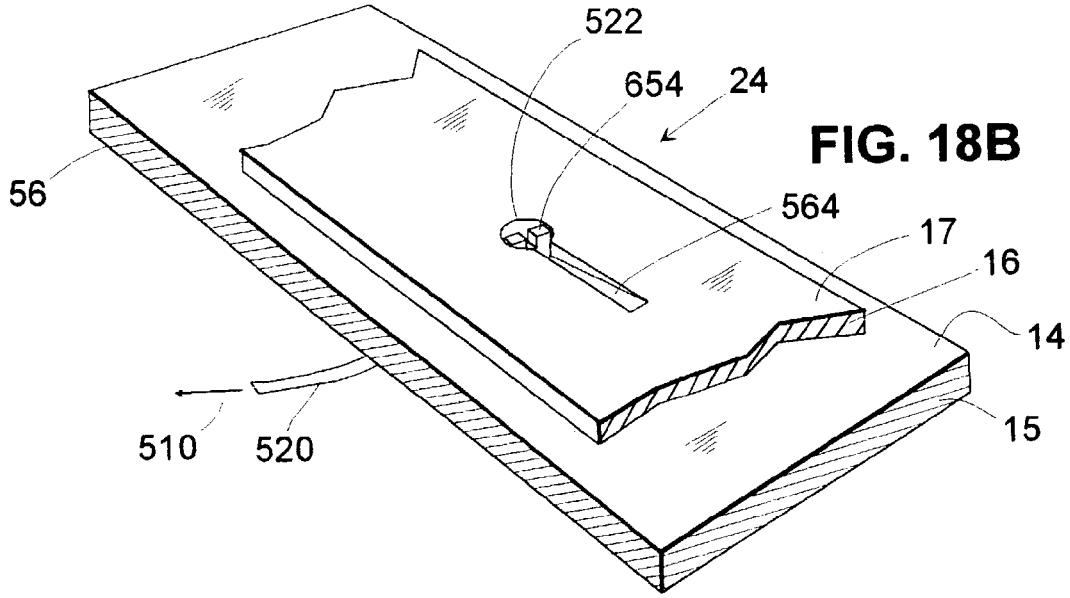

FIGS. 18A and 18B are elevated perspective views of a one-lane portion taken about a finish line section 58 of a racetrack, as were the views of FIGS. 12A and 12B. FIGS. 18A and 18B show an alternative configuration to that shown in FIGS. 12A and 12B for assembling a slotted finish sensor to a lane of a track at the finish line 24. This alternative is for use with collision block assemblies 502, 504, 506, 550, 570, 590, and 610 as already described with references to FIGS. 11, 13A, 14A, 15A, and 16A. FIG. 18A is an exploded view, and FIG. 18B shows the finished assembly. Both views show the tapered-depth groove 564 described in reference to FIG. 17B. This alternative configuration shows the mounting of a slotted photosensor 654 from underneath the finish line section 56 of a track rather than from above.

In FIGS. 18A and 18B, the slotted photosensor 654 is mounted on a printed circuit board (PCB) 656 much as was described above for the miniature slotted finish sensor 514 with references to FIGS. 12A, 12B, 13B, 13C, 14B, 15B, 15C, 16B, 16C, 17A, and 17B. However, in this case the slotted photosensor 654 is of the standard size variety as used in the prior art and illustrated and described with references to the earlier FIGS. 5A, 5B, 5C, 5D, 8C, and 8D. The cable 520 is shown routed from the printed circuit board 656 in a direction 510 to an electronic processor (as shown in FIG. 3). Note that the slotted photosensor 654 has long leads that supply ample support with which to extend its elevation above the printed circuit board 656. This extensions easily enables the slotted photosensor 654 to be inserted upward into a hole 522 drilled in the center of both the track base 15 and the guide rail 16 at the finish line 24. The top of the printed circuit board 656 then references flush against the bottom side of the track base 16 where it is screwed into place to the track base 16 using two mounting screws 658 with optional washers. In FIG. 18B, the top of the slotted photosensor 654 can be seen to be at the same level as the guide rail top surface 17. By using a thinner track base 15 and/or a thinner guide rail 16, or by extending the slotted photosensor 654 higher above the printed circuit board 656, the top of the slotted photosensor 654 can optionally be positioned above the guide rail top surface 17. FIGS. 18A and 18B both show the race surface 14 for clarity.

Figure 19A:
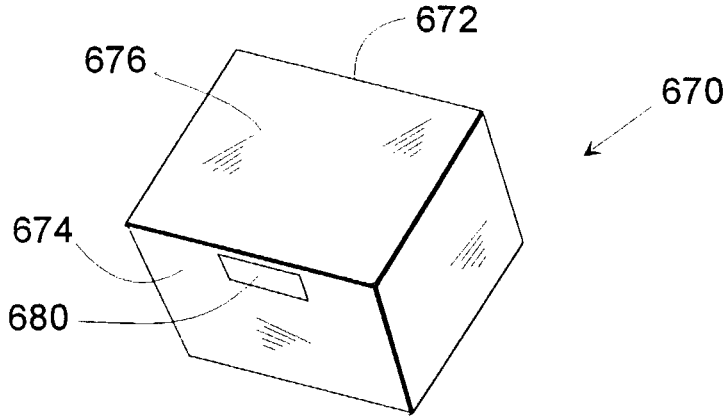
FIG. 19A shows a fourth alternative configuration of a collision obstacle, wherein a region on the bottom surface near an edge with a collision surface is made conductive.

FIG. 19A shows a fourth alternative configuration of a collision obstacle assembly 670, wherein a cooperative element 680 (a sensor-interaction feature) is conductive or reflective and is attached to the bottom surface 674 (or an integral part of the bottom surface 674) of a collision block 672 and near to an edge with a collision surface 676.

Figure 19B:
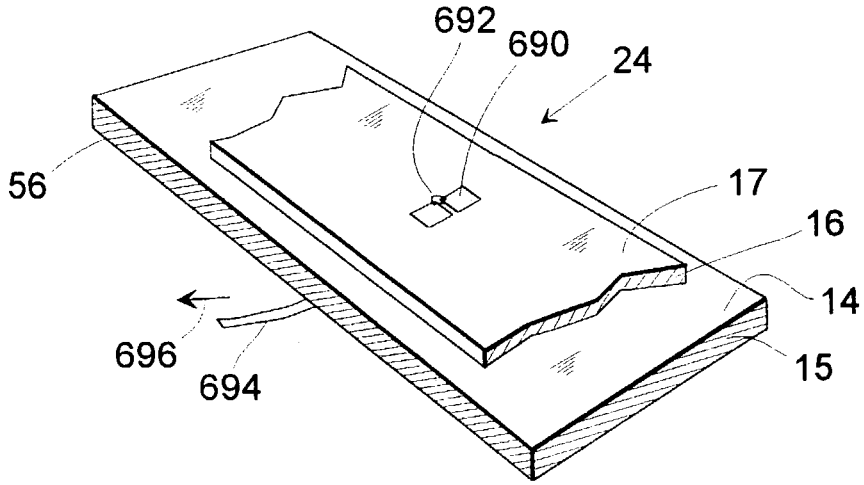
FIG. 19B shows a matching alternative configuration of a finish sensor, wherein the surfaces of two electrodes comprises a capacitance sensor that is positioned at the finish line on a guide rail in the lane of a track.

FIG. 19B is an elevated perspective view of a one-lane portion taken about a finish line section 58 of a racetrack, as were the views of FIGS. 12A, 12B, 18A, and 18B. The track base 15 is shown with its race surface 14 supporting the guide rail 16 having the guide rail top surface 17. FIG. 19B shows a finish sensor configuration that can be used to sense the presence or absence of the cooperative element 680 that is on the collision obstacle assembly 670 just described. This alternative finish sensor is a capacitance sensor and is comprised of an electrode pair 690, wherein the two electrodes each have an area and are positioned at the finish line 24 on the guide rail top surface 17. A cable 694 carrying a wire from each of the electrodes in the electrode pair 690 is routed through a cable hole 692 and exits from underneath the finish section 56 of a track into a direction 696 toward an electronic processor 108. The electronic processor 108 is shown in FIG. 3.

Figure 19C:
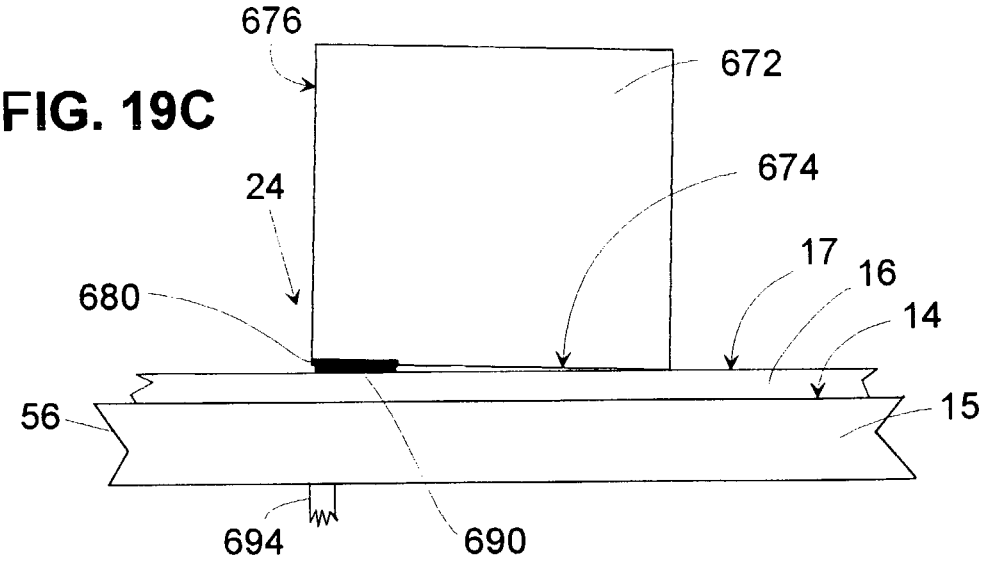
FIG. 19C shows the block-shaped collision obstacle resting over the electrodes. This configuration permits capacitance sensing of the block (obstacle) and its removal.

FIG. 19C shows the collision obstacle assembly 670 resting on the guide rail top surface 17 with the cooperative element 680 (the sensor-interaction feature) is a conductive element and is positioned over the electrode pair 690. Either of both the cooperative element 680 and the electrode pair 690 have an attached insulating film (not shown) protecting them from direct conductive contact with one another. Placements are prearranged such that the collision surface 676 of the collision block 762 lies over the finish line 24. For clarity, the track base 15 of the track finish line section 56 is shown with its race surface 14 supporting the guide rail 16 having the guide rail top surface 17.

This configuration, as described with references to FIGS. 19*a*, 19*b*, and 19C permits capacitance sensing of the presence of the collision block and its removal from the finish line 24. The capacitance of the electrode pair 690 is relatively small when the collision obstacle assembly 670 is not present. This is because the two electrodes 690 do not have their respective areas facing one another at a close distance apart. However, when the conductive cooperative element 680 is closely separated from the electrode pair 690, the capacitance "seen" by the electrode pair is significantly larger. This change in capacitance is what the processor 108 can be designed to sense. The electronics required within an electronic processor (see the processor 108 in FIG. 3) to utilize an electrode pair 690 to sense the presence or absence of a neighboring body, such as the cooperative element 680, is well known in the prior art. For example, capacitance sensors are disclosed in U.S. Pat. No. 6,472,887, entitled, "Capacitive Sensor for Sensing the Amount of Material in a Container", issued Oct. 29, 2002 to Barclay J. Tullis, Carl Picciotto, and Jun Gao, the teachings of which are herein incorporated by reference. The art disclosed in U.S. Pat. No. 6,472,887 uses two electrodes to sense the presence or absence of an amount of dielectric material in the vicinity of an electrode pair. The collision block 672 can comprise an amount of dielectric material sufficient to permit the electrode pair and processor to sense its presence or absence alone. However, the higher capacitance provided by the cooperative element 680 that is conductive is far easier to sense than an amount of dielectric material. One skilled in the art could easily make the necessary adjustment to sensitivity required for this invention.

FIGS. 19A, 19B, and 19C have been described for the implementation of a finish sensor as a sensor device that is a capacitance sensor. However, with minor changes the finish sensor could be implemented as a sensor device that is a reflective optic sensor. In this case, the cooperative element 680 is made to be reflective rather than conductive. In FIGS. 19B and 19C, a reflective optic sensor can replace the electrode pair 690. Reflective optic sensors are as well known to one skilled in the art as are slotted photosensors which have been described above. Reflective optic sensors can be made to be about the same size as a slotted photosensor. A light source and photodetector are positioned next to one another in a common housing, similarly to that shown in FIG. 4A for a slotted photosensor, but the light from the light source is not directed directly at the photodetector. Instead, the light from the light source is directed toward a reflective surface (such as the cooperative element 680) whereby light reflected by the reflective surface is received and detected by the photodetector. In this case, the removal of the collision obstacle assembly 670 from close proximity with the reflective optic sensor is detected as a cessation of light being detected by the photodetector.

FIGS. 20A, 20B, and 20C show further alternative implementations of collision obstacle assemblies (700, 720, and 740 respectively), wherein some of the other possible structures (other than cubical blocks) are used in the current invention. All of these collision obstacles have a base member 708 with a bottom surface that can be equipped with either an optically opaque flag or a region that is conductive or reflective. And all of these collision obstacles have a collision surface.

FIGS. 20A, 20B, and 20C are all elevated perspective views of collision obstacles oriented relative to the travel direction 706 of a racecar or other moving object. FIG. 20A shows a first collision surface 704 on a first vertical member 702. FIG. 20B shows first 704 and second (705) collision surfaces formed by a pair of vertical members consisting of the first vertical member 702 and a second vertical member 710 respectively. FIG. 20C shows a relatively wide vertical plate 712 (attached to the first 702 and second 710 vertical members) with a third collision surface 714 substituting for the first 704 and second 705 collision surfaces.

FIG. 20D shows the vertical-plate collision obstacle assembly 740 of FIG. 20C positioned over the capacitance sensor (the electrode pair 690 of FIG. 19B) that is installed on the guide rail top surface 17 of the guide rail 16 at the finish line 24 in a lane of a track. The cooperative element 680 is shown on the bottom of the vertical-plate collision obstacle assembly 740. For clarity, the track base 15 of the track finish line section 56 is shown with its race surface 14 supporting the guide rail 16. The cable 694 from the electrode pair 690 is shown exiting the bottom of the track base 16.

Figure 21A:
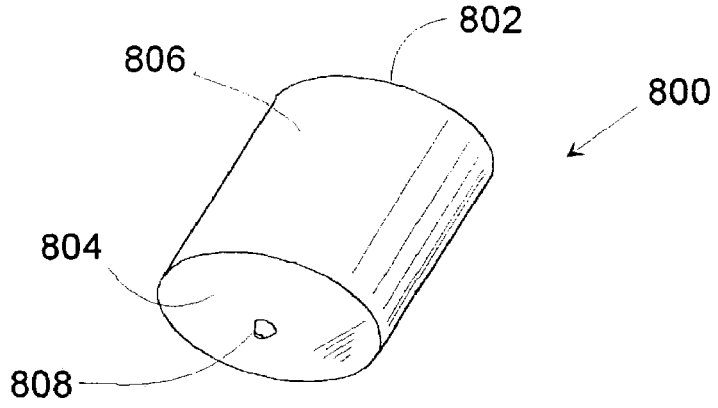
FIG. 21A shows yet another alternative configuration of a collision obstacle assembly, wherein a conical flag is attached to the bottom of a cylindrical body.

FIG. 21A shows Vet another alternative configuration of a collision obstacle or block assembly. In this case, the assembly is a collision obstacle assembly 800 comprised of a collision cylinder 802 having a cylindrical collision surface 806 and a bottom 804 on which is a protruding optically opaque conical flag 808. Optionally, the flag 808 could a cylindrical rod or rectangular rod of constant cross-section rather than tapered as shown.

Figure 21B:
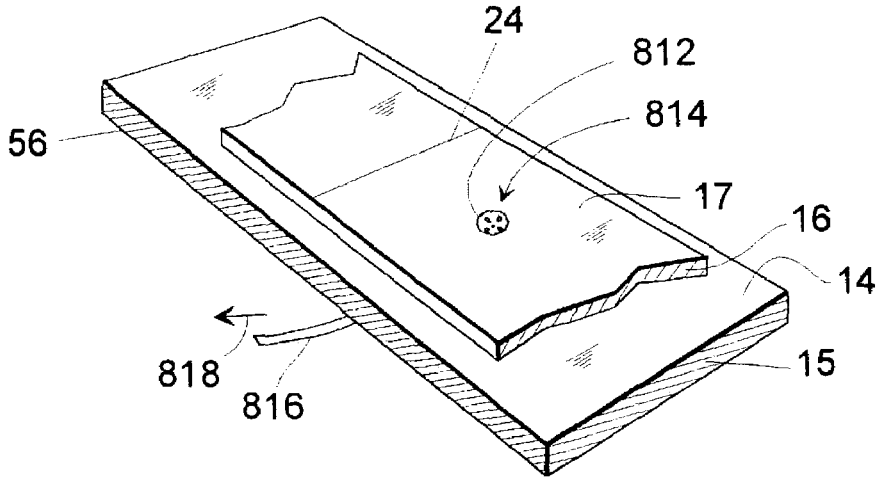
FIG. 21B shows a matching alternative configuration of a finish sensor, wherein a conical depression forms the slot of a "slotted" photosensor.

FIG. 21B is an elevated perspective view of a one-lane portion taken about a finish line section 58 of a racetrack, as were the views of FIGS. 12A, 12B, 18A, 18B, and 19B. The track base 15 is shown with its race surface 14 supporting the guide rail 16 having the guide rail top surface 17. Near to the finish line 24 on the guide rail top surface 17, FIG. 21B shows a conically slotted photosensor 814 having a depression (referred to here as a conically shaped slot) that is conical in shape and serves as a slot to receive a beam-interrupting flag. As with the slotted photosensor described with reference to FIGS. 4A and 4B, a beam of light crosses the slot from a source to a detector. Having a conical slot allows this finish sensor to optionally employ not only one but two beams, perhaps oriented orthogonal to one another. The conically slotted photosensor 814 is used to sense the presence or absence of the collision obstacle assembly 800 shown in FIG. 21A. A cable 816 is routed through a cable hole 812 and exits from underneath the finish section 56 of a track into a direction 318 toward an electronic processor 108 (the electronic processor is shown in FIG. 3).

Figure 21C:
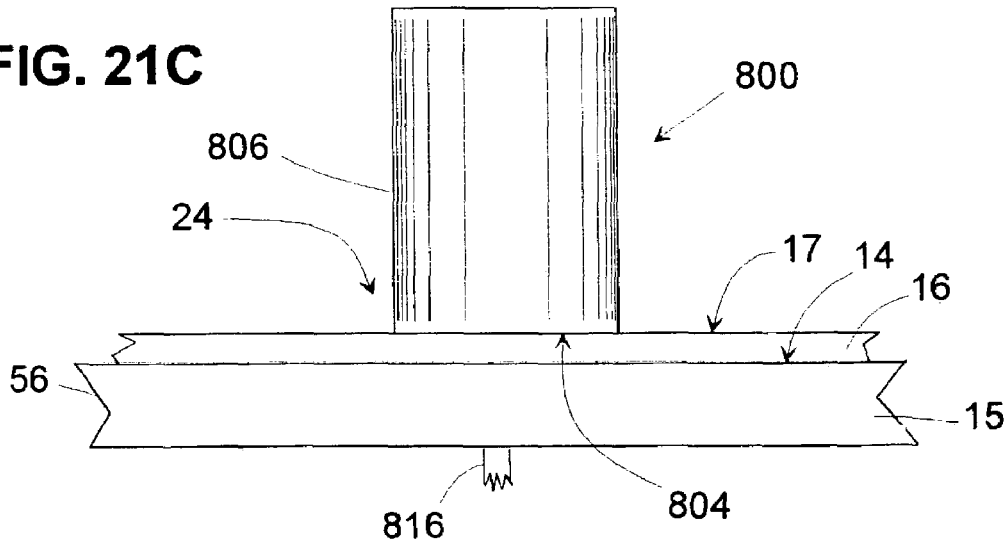
FIG. 21C shows the collision obstacle assembly resting over the "slotted" photosensor.

FIG. 21C shows the collision obstacle assembly 800 resting on the guide rail top surface 17 with the optically opaque conical flag 808 positioned inside the slot of the conically slotted photosensor 814. Placement of the slot of the conically slotted photosensor 814 is prearranged to lie one cylinder radius away from the finish line 24 in the direction toward the end of the track (which is to the right in the view of FIG. 21C). The cable 816 is shown exiting the bottom of the track base 15 immediately underneath the conically slotted photosensor 814. For clarity, the track base 15 of the track finish line section 56 is shown with its race surface 14 supporting the guide rail 16 having the guide rail top surface 17. The described configuration in FIG. 21C is for the detection of the arrival of a racecar from the left-hand side of the collision obstacle assembly 800. In general, however, the cylindrical shape of the collision surface 806 coupled with the conical shape of the conically slotted photosensor 814 comprises a collision sensor that can detect collisions from any direction about the vertical axis of the collision cylinder 802. This nearly omnidirectional property is of great advantage for applications other than timing racecars.

It should be noted that more than a single flag or cooperative element can be located on the bottom of a collision obstacle assembly and that correspondingly more than a single slotted photosensor or electrode pair can be used. An implementation of a cylindrically shaped collision obstacle for use with a conical flag has been described. It should be obvious to one skilled in the art, and having read the descriptions of other implementations above, that the a)

optically opaque conical flag 808 and the b) conically slotted photosensor 814 could be replaced with a a) reflective or conductive cooperative element and a b) reflective optic photosensor or electrode pair, respectively. One skilled in the art should be able to replace the sensor device mounted on a track with any of the sensor types selected from the group including transmissive optical, reflective optical, capacitive, resistive, reactive, inductive, electromagnetic, pneumatic, acoustic, piezoelectric, and mechanical. Correspondingly, one skilled in the art should be able to replace the cooperative element on a collision block with an element suitable to each of the sensor types in the list just given.

Figure 22:
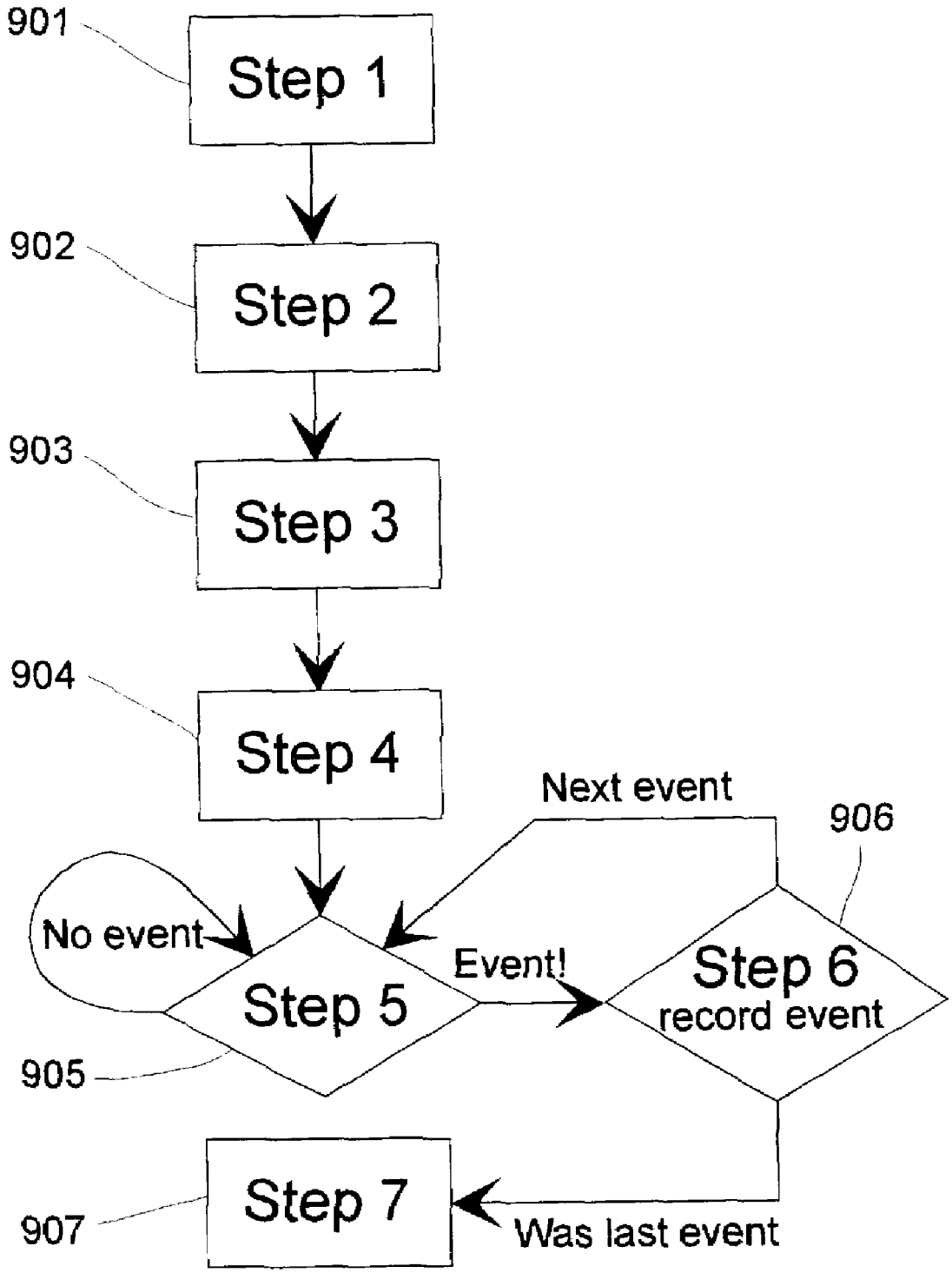
FIG. 22 shows a flow diagram depicting a sequence of steps comprising a method of timing a race using a collision obstacle apparatus at a finish line in each lane of a racetrack.

FIG. 22 shows a flow diagram depicting a sequence of steps comprising a method of timing a race. The method uses an electronic processor 108 (FIG. 3) and a sensing apparatus (e.g. 102, 104, and 106) at a finish line 24 in each lane of a racetrack, wherein each sensing apparatus comprises a freestanding collision obstacle and an associated sensing device installed in the respective lane to provide finish signals (e.g. over interfaces 112, 114, and 116 respectively). Optionally also, a start sensor 100 providing a start signal (over interface 110) is provided at a starting line 22. Further details of each step shown in FIG. 22 are shown in the following description of this method:

901) Step 1: Provide a processor 108 capable of tracking time between one or more finish signals (and optionally a start signal).

902) Step 2: Optionally provide a start sensor 100 at a starting line 22 of a racetrack and coupled by way of an interface 110 to said processor 108 to provide a start signal.

903) Step 3: Provide freestanding collision obstacles resting on the finish line 24 in each lane 16, 18, and of the racetrack.

904) Step 4: Provide a finish sensor device (e.g. 102, 104, and 106) fixed in each lane 16, 18, and 20 at said finish line 24 of said track and coupled by way of an interface (e.g. 112, 114, and 116) to said processor 108 to each provide a finish signal.

905) Step 5: The processor 108 waits for signals to change (i.e. waits for signal events).

906) Step 6: The processor 108 records time and identity of each signal change and goes back to repeat the previous step (Step 5) if not all signals have changed.

907) Step 7: The processor 108 displays (on display 118) the order that finish signals were sensed by lane and, if a start signal was provided, displays elapsed times from start-to-finish for each lane.

Although the invention is described with respect to preferred embodiments, modifications thereto will be apparent to those skilled in the art. The preferred embodiments are described for applications to detect the sequential order of racecars crossing a finish line or to measure their elapsed race times. However, the current invention also applies to detecting the event (or moment of the event) of any moving object colliding with (or nudging) a collision obstacle with sufficient force to jar or move it from a freestanding position. Therefore, the scope of the invention is to be determined by reference to the claims that follow.

I claim:

1. A first sensing apparatus for sensing passage of a first moving object past a first position along a first predefined path, the first sensing apparatus comprising:

a first freestanding collision obstacle placed at said first position in said first predefined path;

a first sensor device able to sense the presence or absence of said first freestanding collision obstacle at said first position, wherein said first sensor device is installed in a first lane of a racetrack; and at least a second sensing apparatus with a respective second sensor device installed in a respective second lane of said racetrack to detect passage of a second moving object passed said second sensor device;

wherein said first moving object collides with said first freestanding collision obstacle as said first moving object passes said first sensor device; and wherein at least the two sensing apparatuses are coupled to an electronic system for determining one of the group including a) the sequential order of said moving objects passing said sensor devices and b) race times of said moving objects, said race times terminated by passage of said moving objects passed said sensor devices.

2. The first sensing apparatus of claim 1, wherein said first freestanding collision obstacle comprises elastic foam material.

3. The first sensing apparatus of claim 1, wherein the first sensor device comprises an optical sensor.

4. The first sensing apparatus of claim 3, wherein the first sensor device utilizes at least one wavelength that is any of the group including infrared, visible, and ultraviolet.

5. The first sensing apparatus of claim 3, wherein the first sensor device comprises a slotted photosensor.

6. The first sensing apparatus of claim 5, wherein the first freestanding collision obstacle includes a flag feature that is positioned to interrupt the slotted photosensor when said first freestanding collision obstacle is placed at said first position.

7. The first sensing apparatus of claim 1, wherein the first sensor device comprises a reflective optic sensor.

8. The first sensing apparatus of claim 1, wherein the first sensor device comprises a capacitance sensor.

9. The first sensing apparatus of claim 8, wherein the first sensor device is able to sense the capacitance of said first freestanding collision obstacle whenever said first freestanding collision obstacle is located at said first position.

10. A sensing apparatus for determining the outcome of a toy racecar race, said race utilizing racecars that travel along respective paths determined by lanes on a track such that each racecar crosses a finish line, the sensing apparatus comprising:

a respective freestanding collision obstacle placed at the finish line in the path of each racecar;

a respective object-sensing device installed in the track beneath each said freestanding collision obstacle, each said object-sensing device capable of sensing the presence or absence of a freestanding collision obstacle, whereby racecars collide with the freestanding collision obstacles as they cross the finish line.

11. A method of sensing the passage of a first moving object passed a first position along a first path, sensing at least a second moving object passed a second position along a second path, and displaying a race result, the method comprising the steps of:

providing a first freestanding collision obstacle positioned at said first position;

providing a first sensor device that is fixed and motionless at said first position, said first sensor device providing a first signal in response to the presence or absence of said first freestanding collision obstacle;

using said first signal from said first sensor device to determine a first moment-in-time at which said first moving object passes said first position;

providing a second freestanding collision obstacle positioned at said second position;

providing a second sensor device fixed at said second position, said second sensor device providing a second signal in response to the presence or absence of said second freestanding collision obstacle;

using said second signal from said second sensor device to determine a second moment-in-time at which said second moving object passes said second position; and displaying at least one of the group including an event time, a lap time, a finish time, a time duration from a start to a finish of a race, a sequential order.

12. A first sensing apparatus for sensing passage of a first moving object past a first position along a first predefined path, the first sensing apparatus comprising:

a first freestanding collision obstacle placed at said first position in said first predefined path; and a first sensor device able to sense the presence or absence of said first freestanding collision obstacle at said first position;

wherein said first moving object collides with said first freestanding collision obstacle as said first moving object passes said first sensor device;

wherein said first moving object is a toy vehicle racing against at least one of other toy vehicles; and wherein said first moving object is a pinewood derby racecar.

* * * * *